US008774655B2

(12) United States Patent
Usami et al.

(10) Patent No.: US 8,774,655 B2
(45) Date of Patent: Jul. 8, 2014

(54) IMAGE FORMING APPARATUS

(75) Inventors: Motohiro Usami, Kanagawa (JP); Takahiro Seki, Kanagawa (JP); Masashi Nagayama, Shizuoka (JP); Shinji Aoki, Kanagawa (JP); Jun Hitosugi, Shizuoka (JP)

(73) Assignee: Ricoh Company, Limited, Tokyo (JP)

( * ) Notice: Subject to any disclaimer, the term of this patent is extended or adjusted under 35 U.S.C. 154(b) by 595 days.

(21) Appl. No.: 12/878,543

(22) Filed: Sep. 9, 2010

(65) Prior Publication Data

US 2011/0058831 A1 Mar. 10, 2011

(30) Foreign Application Priority Data

Sep. 10, 2009 (JP) ..... 2009-209478
Aug. 5, 2010 (JP) ..... 2010-176781

(51) Int. Cl.
*G03G 15/00* (2006.01)

(52) U.S. Cl.
USPC ..... 399/46

(58) Field of Classification Search
USPC ..... 399/46, 51, 53, 66
See application file for complete search history.

(56) References Cited

U.S. PATENT DOCUMENTS

| | | | | |
|---|---|---|---|---|
| 5,893,660 | A * | 4/1999 | Homma et al. | 399/50 |
| 7,668,486 | B2 * | 2/2010 | Kadota et al. | 399/227 |
| 2008/0213684 | A1 | 9/2008 | Nagayama et al. | |
| 2009/0123168 | A1 | 5/2009 | Aoki et al. | |
| 2009/0232526 | A1 | 9/2009 | Yoneda et al. | |

FOREIGN PATENT DOCUMENTS

| | | |
|---|---|---|
| JP | 6-289682 | 10/1994 |
| JP | 9-80880 | 3/1997 |
| JP | 9-106175 | 4/1997 |
| JP | 9-236979 | 9/1997 |
| JP | 10-239981 | 9/1998 |
| JP | 2000-56523 | 2/2000 |
| JP | 2003-84504 | 3/2003 |
| JP | 2003-131444 | 5/2003 |
| JP | 2003-186284 | 7/2003 |
| JP | 2005-165149 | 6/2005 |
| JP | 2005-189767 | 7/2005 |

(Continued)

OTHER PUBLICATIONS

U.S. Appl. No. 12/723,050, filed Mar. 12, 2010, Motohiro Usami, et al.

(Continued)

*Primary Examiner* — Hoang Ngo
(74) *Attorney, Agent, or Firm* — Oblon, Spivak, McClelland, Maier & Neustadt, L.L.P.

(57) ABSTRACT

An apparatus includes: an image carrier; a charger to uniformly charge a surface of the image carrier; an exposing unit to perform write scanning on the image carrier; a developing unit that includes a developer carrier carrying a developer including a toner and that is configured to perform a visible image process on an electrostatic latent image formed on the image carrier; and a transferor to transfer a toner image that has been subjected to the process onto a material. If length Lg of a non-image part directly before an image part in an image carrier moving direction has the relation of $$Lg \geq \pi \cdot Ds/(Vs/Vp),$$

where Vp and Vs are circumferential velocities of the image carrier and the developer carrier and Ds is a diameter of the developer carrier, suppression of toner attachment on the material is controlled in a predetermined length from an image front end in the direction.

12 Claims, 17 Drawing Sheets

(56) References Cited

FOREIGN PATENT DOCUMENTS

| | | |
|---|---|---|
| JP | 3697465 | 7/2005 |
| JP | 2006-220749 | 8/2006 |
| JP | 2007-86448 | 4/2007 |
| JP | 2007-264336 | 10/2007 |
| JP | 2007-272153 | 10/2007 |

OTHER PUBLICATIONS

Office Action mailed Feb. 25, 2014 in Japanese Patent Application No. 2010-176781 filed Aug. 5, 2010.

* cited by examiner (ORIGINAL IMAGE)

(IMAGE WHEN CONTROL IS NOT PERFORMED)

(IMAGE WHEN CONTROL IS PERFORMED ON (P1))

(IMAGE WHEN CONTROL IS PERFORMED ON (P1) AND (P2A,B))

(IMAGE WHEN IT IS DIVIDED INTO TWO IN MAIN SCANNING DIRECTION AND CONTROL IS PERFORMED ON EACH AREA)

ORIGINAL IMAGE

PRIMARY TRANSFER IMAGE FORMED BY CONVENTIONAL IMAGE FORMING APPARATUS (WHEN TRANSFER CURRENT IS CONTROLLED TO CONSTANT VOLTAGE OR CURRENT)

PRIMARY TRANSFER IMAGE ACCORDING TO EMBODIMENT OF PRESENT INVENTION

FIG. 18

| | CONTROL ITEMS | IMAGE CREATING CONDITION | IMAGE PATTERN | | | |
|---|---|---|---|---|---|---|
| | | | BEFORE CHANGE | NON-IMAGE PART | | |
| | | | AFTER CHANGE | HALF TONE (IMAGE AREA RATE 85%) | | |
| | | | TC [wt%] | 5.1 | 7.5 | 9.2 |
| ΔID | PHOTOCONDUCTOR EXPOSURE POWER [J/m²] | REFERENCE CONDITION | | 0.025 | 0.038 | 0.042 |
| | | ADJUSTMENT CONDITION | | −0.003 | 0.002 | −0.002 |
| | PHOTOCONDUCTOR EXPOSURE TIME [ns] | REFERENCE CONDITION | | 0.025 | 0.038 | 0.042 |
| | | ADJUSTMENT CONDITION | | 0.006 | 0.001 | 0.002 |
| | DEVELOPING BIAS [V] | REFERENCE CONDITION | | 0.025 | 0.038 | 0.042 |
| | | ADJUSTMENT CONDITION | | −0.004 | 0.002 | 0.007 |

| | CONTROL ITEMS | IMAGE CREATING CONDITION | IMAGE PATTERN | | | |
|---|---|---|---|---|---|---|
| | | | BEFORE CHANGE | SOLID | | |
| | | | AFTER CHANGE | HALF TONE (IMAGE AREA RATE 55%) | | |
| | | | TC [wt%] | 4.5 | 7.4 | 9.3 |
| ΔID | PHOTOCONDUCTOR EXPOSURE POWER [J/m²] | REFERENCE CONDITION | | −0.011 | −0.024 | −0.035 |
| | | ADJUSTMENT CONDITION | | 0.003 | 0.002 | −0.001 |
| | PHOTOCONDUCTOR EXPOSURE TIME [ns] | REFERENCE CONDITION | | −0.011 | −0.024 | −0.035 |
| | | ADJUSTMENT CONDITION | | −0.002 | 0.003 | 0.001 |
| | DEVELOPING BIAS [V] | REFERENCE CONDITION | | −0.011 | −0.024 | −0.035 |
| | | ADJUSTMENT CONDITION | | −0.001 | 0.000 | 0.003 |

| | CONTROL ITEMS | IMAGE CREATING CONDITION | IMAGE PATTERN | | | |
|---|---|---|---|---|---|---|
| | | | BEFORE CHANGE | HALF TONE (IMAGE AREA RATE 15%) | | |
| | | | AFTER CHANGE | HALF TONE (IMAGE AREA RATE 75%) | | |
| | | | TC [wt%] | 3.8 | 6.9 | 8.9 |
| ΔID | PHOTOCONDUCTOR EXPOSURE POWER [J/m²] | REFERENCE CONDITION | | 0.013 | 0.019 | 0.025 |
| | | ADJUSTMENT CONDITION | | 0.002 | 0.004 | 0.003 |
| | PHOTOCONDUCTOR EXPOSURE TIME [ns] | REFERENCE CONDITION | | 0.013 | 0.019 | 0.025 |
| | | ADJUSTMENT CONDITION | | 0.003 | 0.001 | 0.000 |
| | DEVELOPING BIAS [V] | REFERENCE CONDITION | | 0.013 | 0.019 | 0.025 |
| | | ADJUSTMENT CONDITION | | −0.001 | 0.002 | 0.004 |

FIG. 19

| | CONTROL ITEMS | IMAGE CREATING CONDITION | IMAGE PATTERN | |
|---|---|---|---|---|
| | | | BEFORE CHANGE | NON-IMAGE PART |
| | | | AFTER CHANGE | HALF TONE (IMAGE AREA RATE 70%) |
| ΔID | PHOTOCONDUCTOR EXPOSURE POWER [J/m$^2$] | REFERENCE CONDITION | | 0.052 |
| | | ADJUSTMENT CONDITION | | 0.002 |
| | PHOTOCONDUCTOR EXPOSURE TIME [ns] | REFERENCE CONDITION | | 0.052 |
| | | ADJUSTMENT CONDITION | | 0.002 |
| | DEVELOPING BIAS [V] | REFERENCE CONDITION | | 0.052 |
| | | ADJUSTMENT CONDITION | | 0.001 |

| | CONTROL ITEMS | IMAGE CREATING CONDITION | IMAGE PATTERN | |
|---|---|---|---|---|
| | | | BEFORE CHANGE | SOLID |
| | | | AFTER CHANGE | HALF TONE (IMAGE AREA RATE 70%) |
| ΔID | PHOTOCONDUCTOR EXPOSURE POWER [J/m$^2$] | REFERENCE CONDITION | | −0.041 |
| | | ADJUSTMENT CONDITION | | 0.002 |
| | PHOTOCONDUCTOR EXPOSURE TIME [ns] | REFERENCE CONDITION | | −0.041 |
| | | ADJUSTMENT CONDITION | | −0.001 |
| | DEVELOPING BIAS [V] | REFERENCE CONDITION | | −0.041 |
| | | ADJUSTMENT CONDITION | | 0.003 |

| | CONTROL ITEMS | IMAGE CREATING CONDITION | IMAGE PATTERN | |
|---|---|---|---|---|
| | | | BEFORE CHANGE | HALF TONE (IMAGE AREA RATE 20%) |
| | | | AFTER CHANGE | HALF TONE (IMAGE AREA RATE 70%) |
| ΔID | PHOTOCONDUCTOR EXPOSURE POWER [J/m$^2$] | REFERENCE CONDITION | | 0.034 |
| | | ADJUSTMENT CONDITION | | 0.001 |
| | PHOTOCONDUCTOR EXPOSURE TIME [ns] | REFERENCE CONDITION | | 0.034 |
| | | ADJUSTMENT CONDITION | | −0.002 |
| | DEVELOPING BIAS [V] | REFERENCE CONDITION | | 0.034 |
| | | ADJUSTMENT CONDITION | | 0.004 |

IMAGE FORMING APPARATUS

CROSS-REFERENCE TO RELATED APPLICATIONS

The present application claims priority to and incorporates by reference the entire contents of Japanese Patent Application No. 2009-209478 filed in Japan on Sep. 10, 2009 and Japanese Patent Application No. 2010-176781 filed in Japan on Aug. 5, 2010.

BACKGROUND OF THE INVENTION

1. Field of the Invention

The present invention relates to an image forming apparatus, and more particularly, to a mechanism that resolves a density deviation in a toner image formed on a latent image carrier.

2. Description of the Related Art

As is generally known, in electrophotographic image forming apparatuses, electrostatic latent images formed on photoconductors, which are latent image carriers, are converted to visible images with toners, and toner images are transferred and fixed onto recording media (hereinafter, referred to as recoding materials for convenience) such as recording paper to obtain copied outputs.

Image forming apparatuses not only include those having monochrome image forming configurations but also those having configurations for forming images of plural colors, like full color images. In such a color image forming apparatus, images of different colors formed in plural image forming units are sequentially transferred onto an intermediate transfer body such as a belt (primary transfer), and thereafter superimposed images are collectively transferred onto a recording material (secondary transfer).

For a developing device used in a visible image process, a two-component developer including a toner and magnetic particles that function as a carrier, or a single-component developer not including a carrier is used.

When the single-component developer is used, the toner is charged when the toner passes a layer thickness regulation blade. However, since it is difficult to saturate a toner attachment amount on a developing roller by one-time feeding from a feeding roller to a developing roller, a so-called development history (ghost) occurs where an image density upon continuous printing of a solid image of a large area becomes different from a density of a solid image directly after a large non-image region.

This development history (ghost) corresponds to a phenomenon in which a so-called unnecessary after-image, for example, an after-image of a character within a halftone image, that is, an image of a different density, appears. It has been disclosed that this is caused by the difference in triboelectricities (charge quantities per unit area) of toners on the developing toner, that is, the difference in triboelectricities between the toner facing an image (a developing part) and a toner facing a non-image part (a non-developing part) (for example, see Japanese Patent Application Laid-open No. 09-106175). That is, the toner facing the non-developing part is not transferred toward an electrostatic latent image for development and thus is rubbed against the layer thickness regulation blade more frequently than the toner in the part transferred toward the electrostatic latent image. As a result, the triboelectricity of the toner in the non-developing part increases more than the toner in the developing part, leading to the density unevenness.

Thus, when the single-component developer is used, a velocity of a feeding roller may be increased in an attempt to increase a velocity of feeding the toner from the feeding roller to the developing roller, but if this is done, heat is generated in a contact portion between the developing roller and the feeding roller, and thus the toner on the regulation blade may be fixed to the developing roller, or toner deterioration may be accelerated.

Further, even if the abutting pressure between the feeding roller and the developing roller is increased in order to increase a toner feed quantity or the abutting pressure between the regulation blade and the developing roller is increased in order to obtain saturation with a low attachment amount, the fixing or toner deterioration may be similarly accelerated.

Meanwhile, increasing the number of feeding rollers in order to increase the feed quantity is disadvantageous in terms of volume (downsizing) of a developing machine. Particularly, in recent single-component developing machines, line speeds of the developing rollers have increased more and more due to a demand for higher printing speeds, and it has been difficult to saturate feeding of a toner from a feeding roller to a developing roller at once due to heat generation. Because of these problems, the single-component developing system is hardly employed in printing devices requiring high image qualities.

When the two-component developer is used, because stirring and mixing of the carrier and the toner are able to be sufficiently performed, the above problems occurring with respect to the single-component developer do not occur as much, but the above developing history problem still occurs.

Particularly, when the developing part reaches a developing position directly after the non-developing part, the density of a front end of an image part in an image transferred onto a recording material becomes high as illustrated in FIG. 22.

The inventors of the present application have studied the phenomenon of the front end of the image part directly after the non-image part becoming dense and found out that when a developing sleeve used as a developer carrier is positioned directly after the non-image part, the toner is attached to a surface thereof.

When performing reversal image forming of removing a charge on the photoconductor corresponding to the image part and attaching the toner having the same polarity as the non-image part of the photoconductor by a developing bias, as the non-image part passes the developing sleeve, the toner receives a force moving toward the developing sleeve due to an electric field formed by the charge remaining in the non-image part on the photoconductor. Accordingly, the toner attachment amount on the surface of the developing sleeve increases.

In the image part directly after the non-image part on the photoconductor passes the developing sleeve at which the toner attachment amount has increased, more toner than a toner attachment amount of a predetermined density is attached, and density abnormality at the front end of the image part directly after the non-image part occurs. More particularly, the density becomes higher than the density in the image part other than the front end of the image part.

The deviation in the density at the front end of the image part directly after the non-image part becoming abnormal, that is, the development history that becomes the so-called ghost, is considered to be caused when a development history of a previous round of the developing sleeve remains on the developing sleeve in the developing process, and a development history of the first round is generated as an after-image during development of a second round.

As a method of resolving the density deviation, a method of reducing the density deviation by providing an electrode plate facing a developer carrier and applying a vibration electric field to the electrode plate to rearrange a toner on the carrier and destroy an after-image has been proposed (for example, see Japanese Patent Application Laid-open No. 09-106175).

Further, other methods are available, including a method of regulating a particle diameter distribution and a circularity of a carrier and reducing density unevenness by using a method of carrying a developer similar to the method of carrying the two-component developer via the carrier and using a method similar to the visible image process for using the single-component developer in which the toner flies to the latent image at the portion facing the image part (for example, see Japanese Patent Application Laid-open No. 2007-264336), a method of removing a condition in which a development history is generated by peeling off a remaining toner from a developer carrier after development (for example, see Japanese Patent Application Laid-open No. 2007-86448), and a method of eliminating density deviation by adjusting a stirring time in a developing unit before development according to the number of accumulated printed sheets and eliminating a charge amount difference on a developer carrier with respect to a non-image part and an image part (for example, see Japanese Patent Application Laid-open No. 2006-220749).

Further, other methods have been proposed, including a method of preventing a density at a front end of an image part directly after a non-image part from increasing, a method of controlling a voltage applied to a layer thickness regulation member for a single-component developer (for example, Japanese Patent Application Laid-open No. 2005-189767), and a method of setting a surface material of a developer carrier or controlling a potential in a non-image region so that a charge of a toner does not change (for example, see Japanese Patent Application Laid-open No. 2003-84504).

All of the methods disclosed in the above described patent documents relate to single-component developers and are not targeted on the two-component developers.

The friction charging used for the two-component developers is different from that for the single-component developers, and thus the above-described methods are not directly applicable.

Meanwhile, when the two-component developers are used, similarly to the single-component developers, the density deviation in an image occurs at the front end of the image part directly after the non-image part as described above.

Particularly, the inventors have confirmed that the density deviation occurs even if the developer is peeled off from the developer carrier by a magnetic force in using the two-component developers. Therefore, it is difficult to completely remove the development history upon use of the two-component developers even if the above-described methods are used.

SUMMARY OF THE INVENTION

It is an object of the invention to at least partially solve the problems in the conventional technology.

According to an aspect of the present invention, an image forming apparatus includes: an image carrier; a charging unit configured to uniformly charge a surface of the image carrier; an exposing unit configured to perform write scanning on the image carrier according to image information; a developing unit that includes a developer carrier configured to carry a developer including a toner and that is configured to perform a visible image process on an electrostatic latent image formed on the image carrier; and a transfer unit configured to transfer a toner image that has been subjected to the visible image process onto a recording material. If length Lg of a non-image part directly before an image part in an image carrier moving direction has the relation of $$Lg \geq \pi \cdot Ds/(Vs/Vp),$$

where Vp is a circumferential velocity of the image carrier, Vs is a circumferential velocity of the developer carrier, and Ds is a diameter of the developer carrier, control of suppressing a toner attachment amount on the recording material is performed in a predetermined length from an image front end in the image carrier moving direction.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 18 is a view for explaining a density deviation occurrence state when control on an exposure condition and a developing bias condition is performed according to the present embodiment;

FIG. 19 is a view for explaining a case of changing an image area rate in a result illustrated in FIG. 18 in connection with a density deviation occurrence state when control on an exposure condition and a developing bias condition is performed according to the present embodiment;

DETAILED DESCRIPTION OF THE PREFERRED EMBODIMENTS

Hereinafter, embodiments of the invention will be described with reference to the accompanying drawings.

First, an image forming apparatus according to the invention will be described below.

Figure 1:
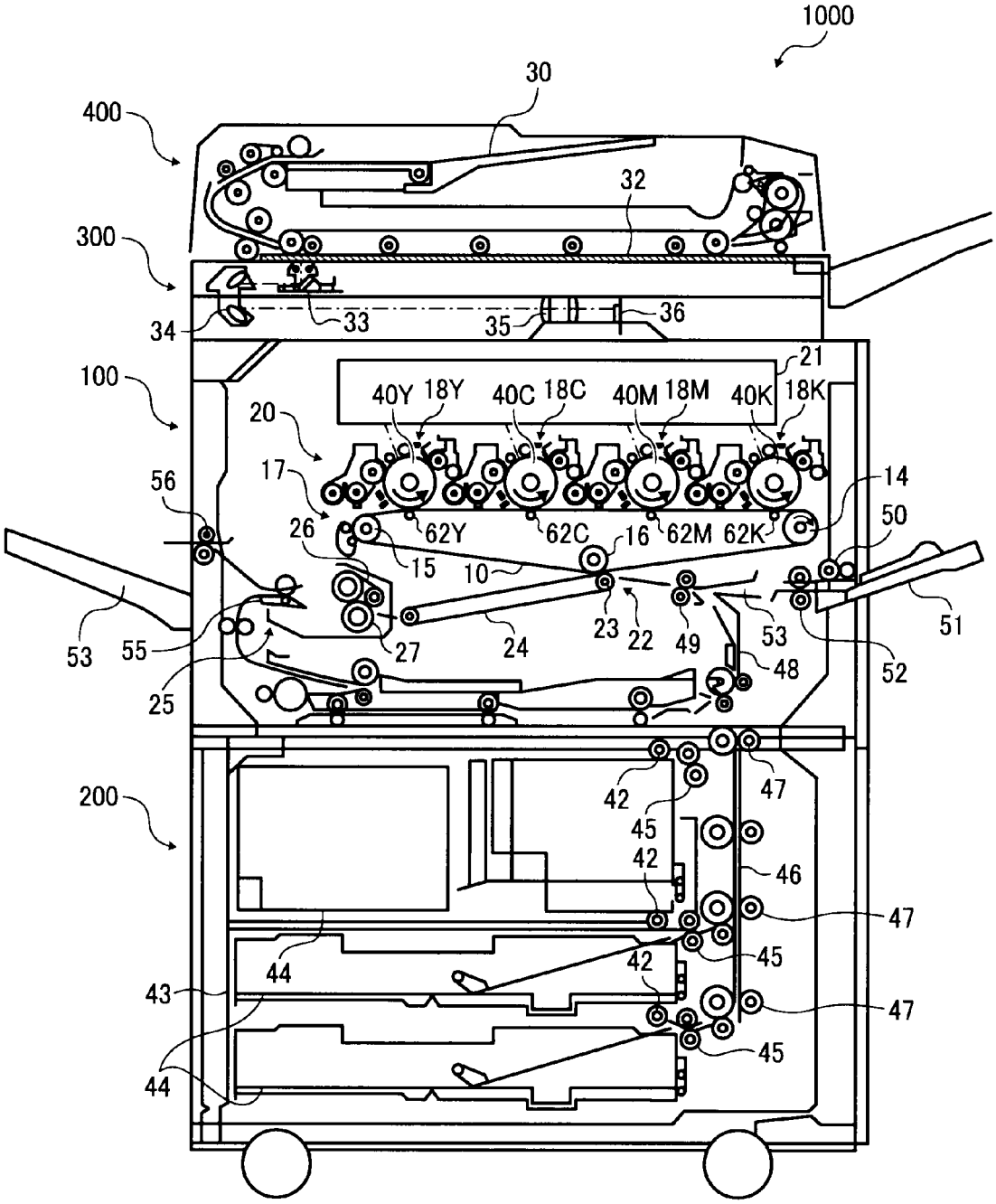
FIG. 1 is a schematic view for explaining an overall configuration of an image forming apparatus according to the invention.

FIG. 1 is a schematic configuration view of a copy machine according to the present embodiment.

Referring to FIG. 1, a copy machine 1000 includes a printer section 100, a feeding device 200 that is mounted below the printer section 100 and feeds a recording material such as a transfer sheet, and a scanner 300 fixed on the printer section 100. The copy machine 1000 further includes an automatic document feeder device 400 (hereinafter, referred to as "ADF") fixed on the scanner 300.

The printer section 100 includes an image forming unit 20 composed of four sets of process cartridges 18Y, 18C, 18M, and 18K for forming images of respective colors of yellow (Y), magenta (M), cyan (C), and black (K). Y, C, M, and K behind symbols or reference numerals represent members for yellow, cyan, magenta, and black, respectively (it is similarly applied in below description). In addition to the process cartridges 18Y, 18C, 18M, and 18K, an optical writing unit 21 as an exposure means, an intermediate transfer unit 17, a secondary transfer device 22, a resist roller pair 49, and a fixing unit 25 of a belt fixing type are disposed.

A configuration of the image forming unit 20 will be described below.

[Optical Writing Unit]

The optical writing unit 21 includes a light source, a polygon mirror, an f-θ lens, and a reflective mirror (not shown) and irradiates laser light to a surface of a photoconductor, which will be described later, based on image data.

[Process Cartridge]

Figure 2:
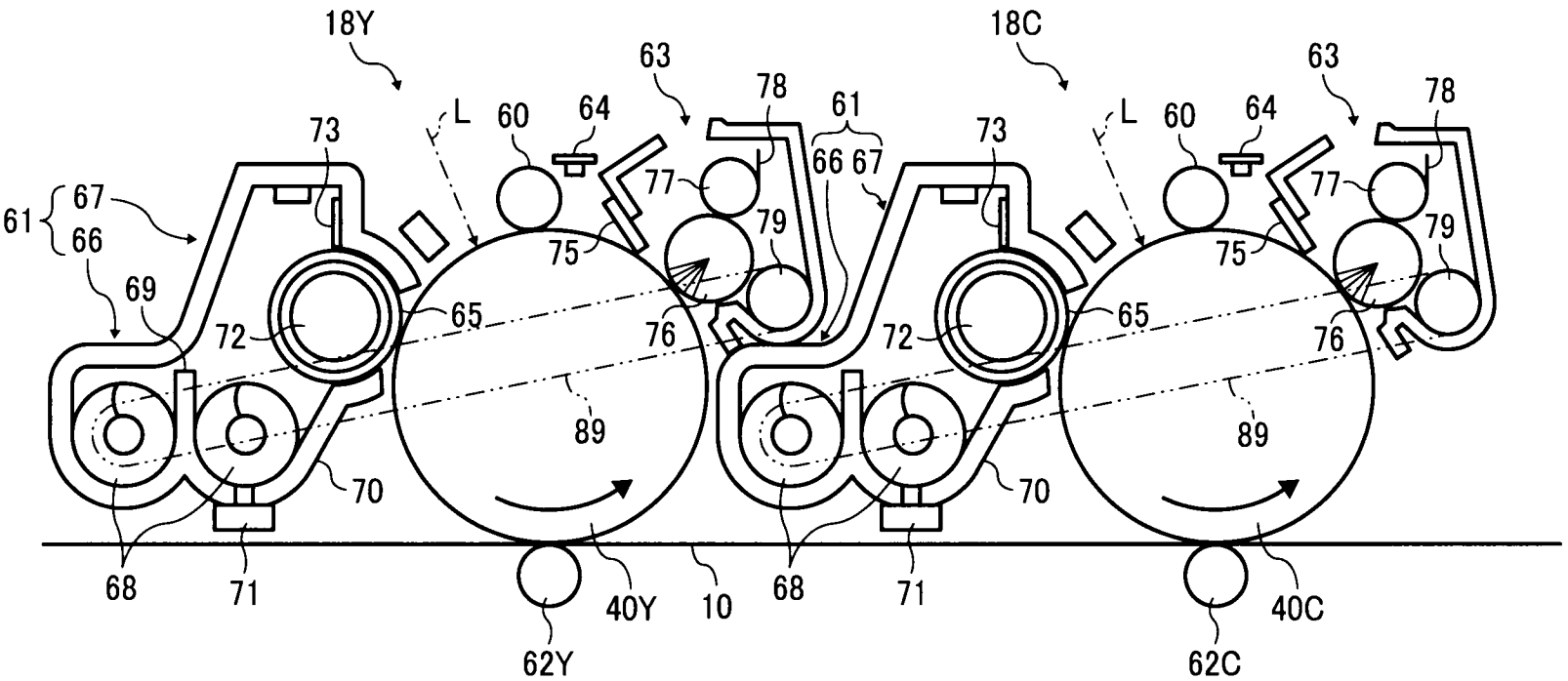
FIG. 2 is a schematic view for explaining a configuration of a process cartridge used in the image forming apparatus illustrated in FIG. 1.

FIG. 2 is an enlarged view illustrating a schematic configuration of the yellow process cartridge 18Y and the cyan process cartridge 18C among the process cartridges 18Y, 18C, 18M, and 18K that configure the image forming unit 20. The other process cartridges 18M and 18K have the same configuration except that color of the toner is different, and thus description thereof will not be repeated.

In FIG. 2, the process cartridges 18Y and 18C as the image creating section for creating a toner image includes drum-shaped photoconductors 40Y and 40C used as an image carrier, chargers 60, developing devices 61, drum cleaning devices 63, and neutralizers 64, respectively.

The charger 60 as a charging means faces a charging roller as a rotary charging member that is rotatably driven while applying a charging bias to the photoconductors 40Y or 40C with a predetermined small gap therebetween. Discharge is generated from the charging roller to the photoconductor 40Y or 40C in the small gap, so that the photoconductor 40Y or 40C is uniformly charged. The reason of rotating the charging roller 60 is to have a roller surface to retreat from the small gap directly after discharge while having a roller surface that is not discharged to enter the small gap, thereby generating stable discharge. As a rotary member used as a charging member, a charging drum or a charging brush of a roller shape may be used instead of the charging roller. In the present copy machine, the surfaces of the photoconductors 40Y and 40C are uniformly charged to −600 (V) by discharge from the charging roller.

Laser light L that is modulated and deflected by the optical writing unit 21 is irradiated to the charged surfaces of the photoconductors 40Y and 40C. As the laser light L is irradiated, an electric potential of an optical writing part (an exposure part) in the photoconductor 40Y is attenuated up to −50 to −500 (V). Due to this attenuation, a Y electrostatic latent image is formed on the surface of the photoconductor 40Y, and a C electrostatic latent image is formed on the surface of the photoconductor 40C. The Y electrostatic latent image is developed into a Y toner image by the developing device 61 as a developing means.

The photoconductors 40Y and 40C have a drum shape in which a plane pipe made of, for example, aluminum is coated with a photoconductive layer made of an organic photosensitive material having photosensitivity and is further coated with a filler reinforced charge transport layer having a thickness of 3.5 to 5.0 (μm). A belt shape may be employed instead of the drum shape.

The developing device 61 as a developing means used for a visible image process of a latent image includes a developing section 67 and a stirring section 66 inside a casing 70. A developing sleeve 65 having a circumferential surface partially exposed through an opening of the casing 70 and a doctor blade 73 are disposed in the developing section 67.

The developing sleeve 65 of a cylindrical shape as a developer carrier is made of a non-magnetic material and has a surface that is roughened at a ten-point average surface roughness Rz of 10 to 12 (μm) by a sandblast process. Due to the roughening, a developer conveying ability increases. Instead of the roughening, small grooves may be formed in the surface. The developing sleeve 65 rotates by a driving means (not shown). Inside the developing sleeve 65, a magnet roller 72 is fixed not to rotate together with the sleeve. The magnet roller 72 includes a plurality of magnetic poles that are divided in a circumferential direction thereof. Due to the influence of the magnetic poles, a magnetic field is formed around the developing sleeve 65.

In the stirring section 66 of the developing device 61, two conveying screws 68 and a toner density sensor 71 (hereinafter, referred to as "T sensor") are disposed, and a magnetic carrier and a Y developer (not shown) containing a negative-charged Y toner are accommodated. The Y developer is stirred and conveyed in a depth direction in FIG. 2 by the two conveying screws 68 and charged in a rubbing manner. The Y developer contacts the surface of the developing sleeve 65 in an axial direction when stirred and conveyed. Due to the influence of the magnetic field extending from the sleeve surface toward the inside of the stirring section 66, the Y developer is carried on the surface of the developing sleeve 65 and is moved up from the inside of the stirring section 66 together with rotation of the sleeve surface. The Y developer is conveyed up to a position facing the doctor blade 73 together with rotation of the sleeve surface. At the facing position, when the Y developer passes through a doctor gap of about 500 μm that is a gap between the developing sleeve 65 and the doctor blade 73, the layer thickness is regulated, and charging of the toner in the rubbing manner is also performed.

The Y developer that passed through the doctor gap reaches a developing area facing the photoconductor 40Y together with rotation of the sleeve surface. In the developing area, the photoconductor 40Y and the developing sleeve 65 face each other with a developing gap of about 350 μm therebetween. On the sleeve surface in the developing area, due to magnetic force from the developing poles (not shown) of the magnet roller 72, a magnetic carrier in the Y developer erects to form a magnetic brush. The magnetic brush moves while rubbing a front end thereof with the photoconductor 40Y to attach the Y toner onto the Y electrostatic latent image on the photoconductor 40Y. Due to this attachment, the Y toner image as the toner image is formed on the photoconductor 40Y. A charge amount of the Y developer conveyed to the developing area is in a range of −10 to −40 μC/g, preferably −15 to −35 μC/g. The magnetic force of the magnet roller 72, the stirring performance, and the doctor gap are set so that the charge amount can be within the range.

The developer that expended the Y toner by development returns to the inside of the developing device 61 together with rotation of the developing sleeve 72. The developer is removed from the sleeve surface due to influence of a repulsive magnetic field formed in the container or gravity and returns to the inside of the stirring section 66 disposed at a position lower than the developing section 67.

Inside the stirring section 66, a partition wall 69 is disposed between the two conveying screws 68. The inside of the stirring section 66 is divided into two by the partition wall 69. Of the two conveying screws 68, one disposed at the right side in FIG. 2 is rotatably driven by a driving means (not shown) and supplies the developer to the developing sleeve 72 while conveying the developer from the front side to the inner side in FIG. 2. The developer conveyed up to an inner end in FIG. 2 is transferred to the conveying screw 68 at the left side in FIG. 2 through an opening (not shown) formed in the partition wall 69. The developer is conveyed from the side to the front side in FIG. 2 by rotational driving of the conveying screw 68 and then returns to the conveying screw 68 at the right side in FIG. 2 through another opening (not shown) formed in the partition wall 69. In this manner, the developer is circulated and conveyed inside the stirring section 66.

The T sensor 71 including a magnetic permeability sensor is disposed below the conveying screw 68 at the right side in FIG. 2 and outputs a voltage having a value depending on magnetic permeability of the Y developer conveyed from the above. The magnetic permeability of the developer has a certain degree of correlation with the toner density, and thus the T sensor 71 outputs a voltage having a value depending on the Y toner density. The value of the output voltage is transmitted to a control section (not shown). The control section includes a random access memory (RAM) and stores Vtref for Y as a target output voltage from the T sensor 71 in the RAM. Further, the control section stores data of Vtref for M, Vtref for C, and Vtref for K as targets of output voltages from T sensors (not shown) mounted in the other developing devices. Vtref for Y is used for driving control of a Y toner feeding device (not shown). Specially, the control section feeds the Y toner to the inside of the stirring section 66 of the developing device 61 by driving-controlling the Y toner feeding device (not shown) so that a value of an output voltage from the T sensor for Y can get close to Vtref for Y. Due to this feeding, the Y toner density of the developer inside the developing device 61 is kept within a predetermined range. The same toner feed control is performed on the developing devices of the other process cartridges.

[Toner Cleaning Device]

The Y toner image formed on the Y photoconductor 40Y is intermediated-transferred (a primary transfer) to an intermediate transfer belt 10 which will be described later. After the intermediate transfer, the residual transfer toner on the surface of the photoconductor 40Y is cleaned by a drum cleaning device 63. The drum cleaning device 63 includes a fur brush 76, a collecting roller 77, a scraper blade 78, a collecting screw 79, and a cleaning blade 75.

The fur brush 76 is a brush of a roller shape in which a plurality of erected fibers made of acrylic carbon is implanted into a core. The fur brush 76 is rotatably driven counterclockwise in FIG. 2 such that a surface thereof moves in a counter direction at a position facing the photoconductor 40Y so that front ends of the erected fibers (not shown) can sequentially rub the photoconductor 40Y in a sliding manner. The collecting roller 77 receives a positive cleaning bias from a power source (not shown) while being rotatably driven in a counterclock direction in FIG. 2 such that a surface thereof moves in a counter direction at a position facing the brush so that the collecting roller 77 can contact the fur brush 76. The residual transfer toner on the photoconductor 40Y is scraped by the erected fibers of the fur brush 76 and captured inside the fur brush 76, and then electrically attached to and collected by the surface of the collecting roller 77 due to influence of the cleaning bias. The collected residual transfer toner is scarped from the roller surface by the scraper blade 78 abutting on the collecting roller 77 and dropped onto the collecting screw 79. The collecting screw 79 that is rotatably driven by a driving means (not shown) receives the dropped residual transfer toner and transmits the dropped residual transfer toner to a toner recycling device 89.

The residual transfer toner that is not completely captured by the fur brush 76 is scraped by a cleaning blade 75 disposed at a downstream side of the brush in a drum rotation direction and captured by the fur brush 76. The cleaning blade 75 is made of an elastic material such as polyurethane rubber.

In the Y process cartridge 18Y, the photoconductor 40Y cleaned by the drum cleaning device 63 is neutralized by the neutralizing device 64. The photoconductor 40Y is uniformly charged by the charging device 60 and returns to an initial state. The processes are performed in a similar manner on the other process cartridges 18C, 18M, and 18K.

[Intermediate Transfer Unit]

Figure 3:
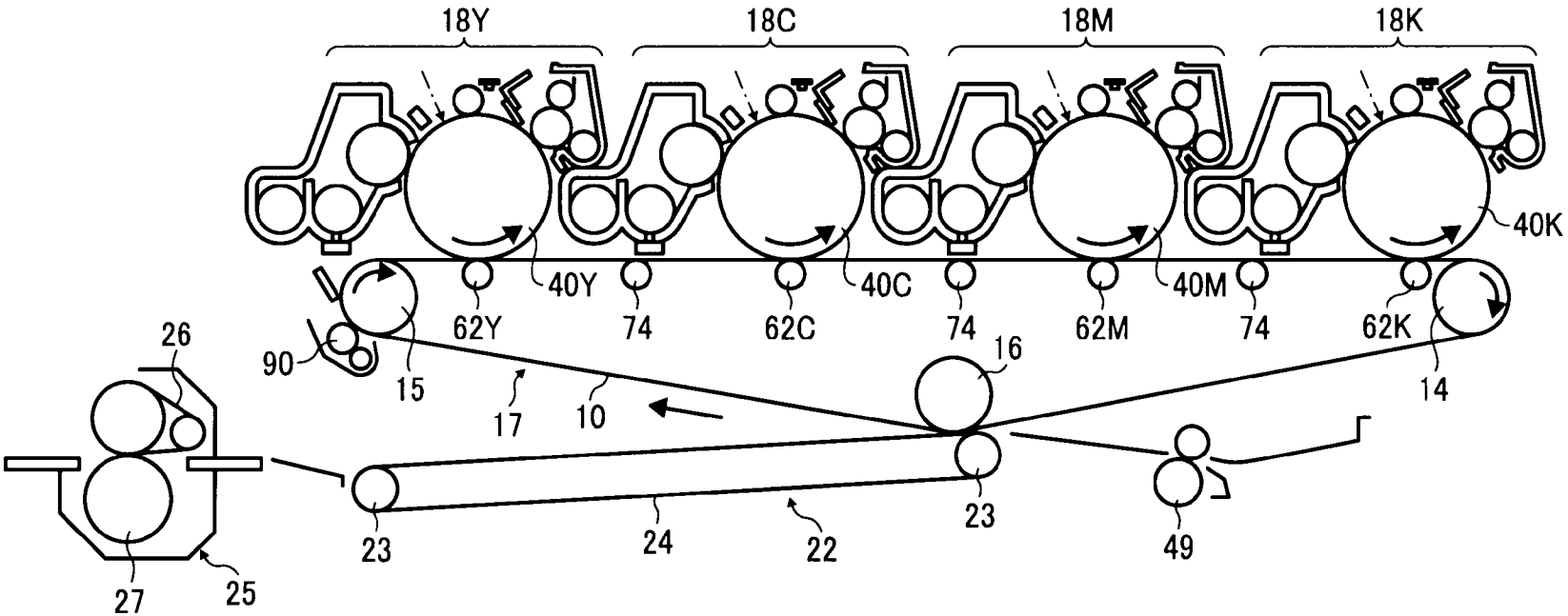
FIG. 3 is a schematic view for explaining an arrangement configuration of a process cartridge and a transfer means illustrated in FIG. 2.

FIG. 3 is an enlarged view illustrating the process cartridges (image forming units) 18Y, 18C, 18M, and 18K, the intermediate transfer unit 17, the secondary transfer device 22, the regist roller pair 49, and the fixing unit 25. The intermediate transfer unit 17 includes an intermediate transfer belt 10 and a belt cleaning device 90. The intermediate transfer unit 17 further includes a stretching roller 14, a driving roller 15, a secondary transfer backup roller 16, four intermediate transfer bias rollers 62Y, 62C, 62M, and 62K, and three ground rollers 74.

The intermediate transfer belt 10 includes a base layer, an elastic layer, and a surface layer (not shown), from the inner side of the belt loop. The base layer is a layer made of fluoric resin with a little stretch or a layer in which a material with a little stretch such as canvas is contained in or stacked on a rubber material with a large stretch. The surface layer is a layer made of a material that has low surface energy and an excellent releasing property for the toner such as fluoric resin. The elastic layer is a layer made of an elastic material such as fluoric resin or acrylonitrile-butadiene copolymer rubber and is formed to provide a certain degree of elasticity to the whole belt.

The intermediate transfer belt 10 is tension-stretched over three rollers including the stretching roller 14. The intermediate transfer belt 10 moves in a clock direction in FIG. 3 in an endless manner by rotation of the driving roller 15 driven by a belt driving motor (not shown). The four intermediate transfer bias rollers 62Y, 62C, 62M, and 62K are disposed to come in contact with the base layer (an inner circumferential surface side) of the intermediate transfer belt 10, respectively, and receives a transfer bias from a power source (not shown). The four intermediate transfer bias rollers 62Y, 62C, 62M, and 62K pressurize the intermediate transfer belt 10 toward the photoconductors 40Y, 40C, 40M, and 40K from the base layer side to form intermediate transfer nips, respectively. In each intermediate transfer nip, due to influence of the intermediate transfer bias, an intermediate transfer electric field is formed between the photoconductor and the intermediate transfer bias roller. The Y toner image formed on the Y photoconductor 40Y is intermediate-transferred onto the intermediate transfer belt 10 due to influence of the intermediate transfer electric field or nip pressure. C, M, and K toner images respectively formed on the photoconductors 40C, 40M, and 40K for C, M, and K are sequentially intermediate-transferred onto the Y toner image in a superimposed manner. Due to the superimposed intermediate transfer, a four-color superimposed toner image (hereinafter, referred to as "four-color toner image) as a multi-toner image is formed on the intermediate transfer belt 10.

A ground roller 74 abuts on a portion of the intermediate transfer belt 10 as a belt member positioned between the intermediate transfer nips from the base layer side. The ground roller 74 is made of a conductive material. Each ground roller 74 prevents an electric current generated by the intermediate transfer bias transferred from each of the intermediate transfer bias rollers 62Y, 62C, 62M, and 62K in the intermediate transfer nips to the belt from leaking to the other intermediate transfer nips or the other process cartridges.

The four-color toner image transferred onto the intermediate transfer belt 10 in the superimposed manner is secondary-transferred onto a recording material (not shown) in a secondary transfer nip which will be described later. The residual transfer toner remaining on the surface of the intermediate transfer belt 10 after passing through the secondary transfer nip is cleaned by the belt cleaning device 90 interposing the belt together with the driving roller 15 at the left side in FIG. 3. In FIG. 3, as the belt cleaning device 90, a fur brush method and a cleaning blade method are combined similarly to the drum cleaning device illustrated in FIG. 2. As the belt cleaning device 90, only one of the methods may be used.

[Secondary Transfer Device]

Referring to FIG. 3, a secondary transfer device 22 in which a paper conveying belt 24 is stretched over two stretching rollers 23 is disposed below the intermediate transfer unit 17. The conveying belt 24 used to convey the recording material moves in a counter clock direction in FIG. 3 in an endless manner together with rotatable driving of at least any one of the stretching rollers 23. Of the two stretching rollers 23, the roller disposed at the right side in FIG. 3 interposes the intermediate transfer belt 10 and the conveying belt 24 together with the secondary transfer backup roller 16 of the intermediate transfer unit 17. Due to the interposing, a secondary transfer nip that comes in contact with the intermediate transfer belt 10 of the intermediate transfer unit 17 and the conveying belt 24 of the secondary transfer device 22 is formed. A secondary transfer bias having a polarity reverse to the toner is applied to any one of the stretching rollers 23 by a power source (not shown).

As the secondary transfer bias is applied, a secondary transfer electric field that electrostatically moves the four-color toner image on the intermediate transfer belt 10 of the intermediate transfer unit 17 from the belt side to any one of the stretching rollers 23 is formed in the secondary transfer nip. The four-color toner image influenced by a secondary transfer electric field or nip pressure is secondary-transferred onto the recording material transported to the secondary transfer nip to be synchronized with the four-color toner image on the intermediate transfer belt 10 by the resist roller pair 49 which will be described later. Instead of the secondary transfer method of applying the secondary transfer bias to any one of the stretching rollers 23 as described above, a charger for charging the recording material in a non-contact manner may be disposed.

[Resist Roller Pair]

At an upstream side of the secondary transfer nip in a belt moving direction, the resist roller pair 49 is disposed. The recording material (not shown) fed to the inside of the printer section 100 from the feeding device 200 which will be described later is interposed between the rollers of the resist roller pair 49. Meanwhile, in the intermediate transfer unit 17, the four-color toner image formed on the intermediate transfer belt 10 enters the secondary transfer nip as the belt moves in an endless manner. The resist roller pair 49 delivers the recording material interposed between the rollers at timing for having it to be closely stuck to the four-color toner image in the secondary transfer nip. As a result, in the secondary transfer nip, the four-color toner image on the intermediate transfer belt 10 is closely stuck to the recording material. The secondary transfer is performed on the recording material, so that a full color image is formed on a white recording material. As the paper conveying belt 24 moves in the endless manner, a recording material P on which a full color image is formed passes through the secondary transfer nip and then conveyed from the paper conveying belt 24 to the fixing unit 25.

[Fixing Unit]

The fixing unit 25 includes a belt unit having a fixing belt 26 stretched over and moved by two rollers and a press roller for pressing the belt unit toward any one of the rollers. The fixing unit 26 and a press roller 27 abut on each other to form the fixing nip, and the transfer sheet received from the paper conveying belt 24 is interposed between the fixing unit 26 and the press roller 27. Of the two rollers in the belt unit, the roller pressurized by pressure from the press roller 27 has a heat source (not shown) thereinside and generates heat to press the fixing belt 26. The pressed fixing belt 26 heats the recording material interposed in the fixing nip. Due to influence of heat generation or nip pressure, a full color image is fixed onto the recording material.

Referring to FIG. 1, the recording paper P that passed through the fixing unit 25 is discharged to the outside through a paper discharge roller pair 56 and stacked on a stack section 57. Alternatively, the recording material P is transported to a paper reversing unit disposed below the fixing unit 25. When the recording material P is transported to the reversing unit, the recording material P is reversed and then conveyed to the secondary transfer nip again. The four-color toner image is secondary-transferred onto the other surface. Thereafter, the recording material P passes through the fixing unit 25 and then is discharged to the outside. Determination as to whether to transport the recording material P to the fixing unit 25 or the reversing unit is made by switching of a recording material conveying path performed by a switching claw 55.

[Operation of the Whole Configuration]

In the case of copying an original document (not shown), for example, a bundle of sheet documents is set on a platen 30 of the automatic document feeder device 400. However, when the original document is a single binding document in which an original document is bound in a book form, the original document is set on a contact glass 32. Before the setting, the automatic document feeder device 400 is opened from the copy machine main body to expose the contact glass 32 of the scanner 300. Thereafter, the single binding document is pressed by the closed automatic document feeder device 400.

After the original document is set in the above-described manner, when a copy start button (not shown) is pressed down, a document reading operation performed by the scanner 300 in FIG. 1 starts. However, when the sheet document is set on the automatic document feeder device 400, before the document reading operation, the automatic document feeder device 400 automatically moves the sheet document to the contact glass 32. In the document reading operation, a first carrier 33 and a second carrier 34 start to move together, and light is emitted from a light source disposed in the first carrier 33. Light reflected from the document surface is reflected by a mirror disposed in the second carrier 34, passes through an imaging lens 35, and is then incident to a reading sensor 36. The reading sensor 36 creates image information based on the incident light.

In parallel with the document reading operation, the devices, the intermediate transfer unit 17, the secondary transfer device 22, and the fixing unit 25 in each of the process cartridges 18Y, 18C, 18M, and 18K start its driving operation. Based on the image information created by the reading sensor 36, driving of the optical writing unit 21 is controlled, so that Y, C, M, and K toner images are formed on the photoconductors 40Y, 40C, 40M, and 40K, respectively. The toner images forms a four-color toner image that is transferred onto the intermediate transfer belt 10 in the superimposed manner.

At the almost same time as the start of the document reading operation, a feeding operation of the recording material, that is, a paper feeding operation on the transfer sheet, start in the feeding device 200. In the feeding operation, one of the feeding rollers is selected and rotates, and thus the recording material is fed from one of feeding cassettes 44 accommodated in multiple stages in a paper bank 43 and delivered toward the conveying path. The delivered recording material is separated one by one by a separating roller 45 and enters a conveying path 46, and then is fed to a paper feeding path 48 in the printer section 100 by a conveying roller 47. The recording material may be fed from a manual tray 51 instead of the feeding cassette 44. In this case, the feeding roller 50 is selected and rotates to deliver the recording material on the manual tray 51. The recording material is separated one by one by a separating roller 52 and fed toward a manual paper feeding path 53 of the printer section 100. The four-color image is secondary-transferred onto the recording material fed to the paper feeding path 48 or the manual paper feeding path 53 of the printer section 100 through the secondary transfer nip. The recording material passes through the fixing unit 25 and then is discharged to the outside.

As the toner used in the image forming apparatus according to the invention, a toner in which an additive is added to mother particles in which materials such as a charge control agent and a release promoting agent are contained in binder resin is preferably used. The release promoting agent of 1 to 15 parts by weight, preferably 2 to 10 parts by weight is contained in binder resin of 100 parts by weight. This is because when a content rate of the release promoting agent is less than 1 part by weight, it is difficult to sufficiently suppress a hot offset of a toner on the fixing belt 26. Further, when the content rate of the release promoting agent exceeds 15 parts by weight, the developing ability deteriorates, an abnormal image is generated due to the agglutinated toner, transfer performance deteriorates, and durability also deteriorates. When the content rate of the release promoting agent has 2 to 10 parts by weight, image density of a solid portion is high, and it is possible to obtain a high quality image having excellent dot reproducibility.

As the release promoting agent, a conventionally known release promoting agent may be used, and examples thereof include low molecular weight polyolefin waxes such as low molecular weight polyethylene and low molecular weight polypropylene; synthetic hydrocarbon-based waxes such as Fischer-Tropsch wax; natural waxes such as beeswax, carnauba wax, candelilla wax, rice wax and montan wax; petroleum waxes such as paraffin wax and microcrystalline wax; higher fatty acids such as stearic acid, palmitic acid and myristic acid, and metal salts of higher fatty acids; higher fatty acid amides; synthetic ester-based waxes; and various modified waxes thereof. These release promoting agents may be used singly or in combination of two or more kinds. Particularly, when carnauba wax or a synthetic ester-based wax is used, satisfactory releasability of the toner from the fixing belt 26 or the photoconductor is obtained.

It is desirable that the amount of addition of the additive that is added to the toner be 0.6 to 4.0 parts by weight relative to 100 parts by weight of the mother particles, and it is more suitable that the amount of addition be 1.0 to 3.6 parts by weight. When the amount of addition of the additives is less than 0.6 parts by weight, an increase in the degree of aggregation between the toner particles caused by the poor fluidity of the toner, leads to insufficient contact with the magnetic carrier, which is constituted of magnetic particles. Furthermore, sufficient electrical chargeability of the toner in the developing machine cannot be obtained. In addition, this increased degree of aggregation may lead to insufficient transferability or heat-resistant storage stability, or is likely to cause scumming or toner scattering. When the amount of addition is larger than 4.0 parts by weight, fluidity is enhanced, but faulty cleaning of the photoconductor caused by chattering or flipping of the cleaning blade, or filming onto the photoconductor by the additives released from the toner is likely to occur. As a result, the durability of a cleaning member such as a cleaning blade or of an object to be cleaned such as a photoconductor is lowered, and fixability is also deteriorated. Particularly, when the amount of addition of the additives is in the range of 1.0 to 3.6 parts by weight, high quality images having a high image density at solid image areas and satisfactory dot reproducibility can be obtained. Here, the term "scumming" refers to a phenomenon in which toner is deposited to the non-image areas of the photoconductor.

As the additive that is added to the toner, a conventionally known additive may be used, and examples thereof include oxides or composite oxides of silicon (Si), titanium (Ti), aluminum (Al), magnesium (Mg), calcium (Ca), strontium (Sr), barium (Ba), indium (In), gallium (Ga), nickel (Ni), manganese (Mn), tungsten (W), iron (Fe), cobalt (Co), zinc (Zn), chromium (Cr), molybdenum (Mo), copper (Cu), silver (Ag), vanadium (V) and Zr (zirconium). Particularly, silica, titania and alumina, which are oxides of Si, Ti and Al, respectively, are suitably used. In regard to the additive, it is preferable to subject the additive to a surface treatment according to the purpose, such as hydrophobization, fluidity enhancement and control of electrical chargeability.

There may be a variety of methods for the measurement of the content of the additive, but the content of the additive is generally determined by an X-ray fluorescence analysis method. An exemplary method includes producing a calibration curve for a toner having an already known content of the additive by an X-ray fluorescence analysis method, and determining the content of the additive of the toner under test using this calibration curve.

The treating agent that is used in the surface treatment of the toner is preferably an organic silane compound or the like. For example, the treating agent is an alkylchlorosilane such as methyltrichlorosilane, octyltrichlorosilane, or dimethyldichlorosilane; an alkylmethoxysilane such dimethyldimethoxysilane or octyltrimethoxysilane; hexamethyldisilazane; or a silicone oil. Examples of the method for surface treatment with a treating agent include a method of submerging the additive in a solution containing an organosilane compound and drying the additive, and a method of spraying a solution containing an organosilane compound onto the additive and drying the additive.

The particle size of the additive that is added to the mother particles of the toner is, from the viewpoint of imparting fluidity or the like, preferably 0.002 to 0.2 (μm), and particularly preferably 0.005 to 0.05 (μm), as the average primary particle size. An additive having an average primary particle size of smaller than 0.002 (μm) is such that the additive is prone to be embedded in the surface of the mother particles, and thus aggregation is likely to occur. Furthermore, sufficient fluidity is not obtained, and filming onto the photoconductor or the like is prone to occur. These tendencies are conspicuous particularly in a high temperature high humidity environment. On the other hand, when the average primary particle size is smaller than 0.002 (μm), aggregation between the additive particles is likely to occur at any rate, and thereby, sufficient fluidity cannot be easily obtained. When the average primary particle size is larger than 0.2 (μm), the poor fluidity of the toner does not allow sufficient electrical chargeability to be obtained, and is likely to cause scumming or toner scattering. Furthermore, when the average primary particle size is larger than 0.1 (μm), the toner particles are likely to damage the photoconductor surface, and is likely to cause filming or the like. The particle size of the additive can be determined by making a measurement using a scanning electron microscope.

As the binding resin, a conventionally known binding resin may be used. For example, a polystyrene, a styrene-butadiene copolymer, a styrene-vinyl chloride copolymer, a styrene-acrylic acid ester copolymer, a styrene-methacrylic acid ester copolymer, an acrylic resin, a polyester resin, an epoxy resin, a polyol resin, a rosin-modified maleic acid resin, a phenolic resin, a low molecular weight polyethylene, a low molecular weight polypropylene, an ionomer resin, a polyurethane resin, a ketone resin, an ethylene-ethyl acrylate copolymer, a polybutyral, or a silicone resin may be used. These may be used singly or in combination of two or more kinds. Particularly, a polyester resin or a polyol resin is preferable. The method for producing the binder resin is not particularly limited, and any one of bulk polymerization, solution polymerization, emulsion polymerization, suspension polymerization and the like can be used.

Various types of polyester resins can be used as the intended polyester resin. Particularly, a mixture of the resins listed in the following groups (a) to (c) may be used:

(a) at least one selected from a divalent carboxylic acid, a lower alkyl ester and an acid anhydride of the carboxylic acid;

(b) a diol component represented by the following formula (1):

(1)

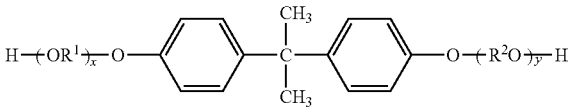

(wherein $R^1$ and $R^2$, which may be identical or different, each represent an alkylene group having 2 to 4 carbon atoms; and x and y represent the numbers of repeating units, each being 1 or greater and x+y=2 to 16); and (c) at least one selected from a polyvalent carboxylic acid having a valence of 3 or higher, a lower alkyl ester and an acid anhydride of the polyvalent carboxylic acid, and a polyhydric alcohol having a valence of 3 or higher.

Examples of the compounds of group (a) include terephthalic acid, isophthalic acid, sebacic acid, isodecylsuccinic acid, maleic acid, fumaric acid, monomethyl, monoethyl, dimethyl and diethyl esters of these acids, phthalic anhydride, and maleic anhydride. Particularly, terephthalic acid, isophthalic acid, or a dimethyl ester of one of these acids is preferable in view of the anti-blocking property and production cost. These divalent carboxylic acids, lower alkyl esters and acid anhydrides of the carboxylic acids largely affect the fixability or anti-blocking property of the toner. Although dependent on the degree of condensation, when a large amount of an aromatic carboxylic acid such as terephthalic acid or isophthalic acid is used, the anti-blocking property is enhanced, while the fixability is decreased. On the contrary, when a large amount of sebacic acid, isodecylsuccinic acid, maleic acid, fumaric acid, or the like is used, the fixability is enhanced, but the anti-blocking property is decreased. Therefore, it is desirable to appropriately select these divalent carboxylic acids in accordance with the compositions or ratios of other monomers, or the degree of condensation, and to use them singly or in combination. Examples of the compounds of group (b) include polyoxypropylene-(n)-polyoxyethylene-(n')-2,2-bis(4-hydroxyphenyl)propane, polyoxypropylene-(n)-2,2-bis(4-hydroxyphenyl)propane, and polyoxyethylene-(n)-2,2-bis(4-hydroxyphenyl)propane. Particularly, a polyoxypropylene-(n)-2,2-bis(4-hydroxyphenyl)propane with $2.1 \leq n \leq 2.5$, or a polyoxyethylene-(n)-2,2-bis(4-hydroxyphenyl)propane with $2.0 \leq n \leq 2.5$ is preferable. Such a diol component hs an advantage that the diol component increases the glass transition temperature and makes the reaction easy to control. It is also possible to use, as the diol component, an aliphatic diol such as ethylene glycol, diethylene glycol, 1,2-butanediol, 1,3-butanediol, 1,4-butanediol, neopentyl glycol or propylene glycol.

Examples of the polyvalent carboxylic acid having a valence of 3 or higher, a lower alkyl ester and an acid anhydride of the polyvalent carboxylic acid of group (c), include 1,2,4-benzenetricarboxylic acid (trimellitic acid), 1,3,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexatricarboxylic acid, 1,3-dicarboxyl-2-methyl-2-methylenecarboxypropane, tetra(methylenecarboxy)methane, 1,2,7,8-octanetetracarboxylic acid, enpol trimeric acid, and monomethyl, monoethyl, dimethyl and diethyl esters of these acids.

An example of the polyhydric alcohol having a valence of 3 or higher of group (c) is sorbitol, 1,2,3,6-hexanetetrol, 1,4-sorbitan, pentaerythritol, dipentaerythritol, tripentaerythritol, sucrose, 1,2,4-butanetriol, 1,2,5-pentatriol, glycerol, diglycerol, 2-methylpropanetriol, 2-methyl-1,2,4-butanetriol, trimethylolethane, trimethylolpropane, or 1,3,5-trihydroxymethylbenzene. The proportion of incorporation of the polyvalent monomer having a valence of 3 or higher is suitably about 1 to 30 [% by mole] based on the total amount of the monomer composition. This is because, when the proportion of incorporation is less than 1 [% by mole], the offset resistance of the toner is decreased, and durability is prone to be deteriorated. Another reason is that, when the proportion of incorporation exceeds 30 [% by mole], the fixability of the toner is prone to be deteriorated.

For the polyvalent monomer having a valence of 3 or higher as described above, a benzenetricarboxylic acid compound such as benzenetricarboxylic acid, or an anhydride or ester of this acid is particularly preferable. When a benzenetricarboxylic acid is used, a good balance between fixability and offset resistance can be obtained.

As the polyol resin mentioned above, any of polyol resins of various types may be used, but particularly, it is preferable to use a product obtained by reacting the substances listed below:

(d) an epoxy resin;

(e) an alkylene oxide adduct of a divalent phenol, or a glycidyl ether of the adduct;

(f) a compound having in the molecule one active hydrogen atom that reacts with an epoxy group; and (g) a compound having in the molecule two or more active hydrogen atoms that react with an epoxy group.

The epoxy resin of group (d) is desirably a product obtainable by bonding a bisphenol such as bisphenol A or bisphenol F, with epichlorohydrin. In particular, a bisphenol A-type epoxy resin containing at least two or more components having different number average molecular weights, with the low molecular weight component having a number average molecular weight of 360 to 2000, and the high molecular weight component having a number average molecular weight of 3000 to 10000, is preferred so that the epoxy resin may obtain a stable fixing property or gloss. Furthermore, an epoxy resin having 20 to 50% by weight of the low molecular weight component and 5 to 40% by weight of the high molecular weight component, is preferred. If the low molecular weight component is present in too much excess or has a molecular weight that is even lower than 360, the resin may have no gloss, or there is a possibility of deterioration in the storage stability. Furthermore, if the high molecular weight component is present in too much excess or has a molecular weight that is even higher than 1000, the resin may have insufficient gloss, or there is a possibility of deterioration in the storage stability.

As the alkylene oxide adduct of a divalent phenol of group (e), the following may be used. For example, a reaction product between ethylene oxide, propylene oxide, butylene oxide or a mixture of these, and a bisphenol such as bisphenol A or bisphenol F may be used. The adduct thus obtained may be further glycidylated with epichlorohydrin, β-methylepichlorohydrin or the like, before use. Particularly, a diglycidyl ether of an alkylene oxide adduct of bisphenol A represented by the following formula is preferred:

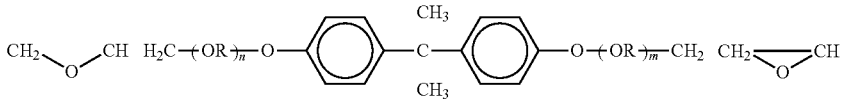

(wherein R represents a —$CH_2$—$CH_2$— group, a —$CH_2$—$CH(CH_3)$— group or a —$CH_2$—$CH_2$—$CH_2$— group; and m and n represent the numbers of repeating units, each being 1 or greater and m+n=2 to 6).

It is preferable that the alkylene oxide adduct of a divalent phenol or a glycidyl ether of the adduct as described above be incorporated in an amount in the range of 10 to 40 [% by weight] relative to the content of the polyol resin. It is because, if the amount of the adduct is less than this range, inconveniences occur such as increased curling. Another reason is that if n+m is 7 or greater, or the adduct is present in too much excess, the resin may have no gloss, or there is a possibility of deterioration in the storage stability.

As the compound of group (f), a monovalent phenol, a secondary amine, a carboxylic acid, or the like may be used. Among these, examples of the monovalent phenol include the following: phenol, cresol, isopropylphenol, aminophenol, nonylphenol, dodecylphenol, xylenol, and p-cumylphenol. Furthermore, examples of the secondary amine include diethylamine, dipropylamine, dibutylamine, N-methyl(ethyl) piperazine, and piperidine. Examples of the carboxylic acid include propionic acid and caproic acid.

Examples of the compound of group (g) include a divalent phenol, a polyvalent phenol, and a polyvalent carboxylic acid. Among these, examples of the divalent phenol include bisphenols such as bisphenol A and bisphenol F. Furthermore, examples of the polyvalent phenol include ortho-cresol novolacs, phenol novolacs, tris(4-hydroxyphenyl)methane, and 1-[α-methyl-α-(4-hydroxyphenyl)ethyl]benzene. Examples of the polyvalent carboxylic acid include malonic acid, succinic acid, glutaric acid, adipic acid, maleic acid, fumaric acid, phthalic acid, terephthalic acid, trimellitic acid, and trimellitic anhydride.

If the polyester resin or polyol resin described above is allowed to have a high crosslinking density, it is difficult to obtain transparency or glossiness in the resin. Accordingly, it is preferable to maintain the resin uncrosslinked, or to have the resin weakly crosslinked (having a THF-insoluble fraction of 5% or less).

As the colorant that is incorporated into the toner, a dye or pigment that is conventionally known may be used. Examples of yellow series colorants include naphthol yellow S, hansa yellow (10G, 5G, G), cadmium yellow, yellow iron oxide, yellow ocher, chrome yellow, titanium yellow, polyazo yellow, oil yellow, hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, benzimidazolone yellow, and isoindolinone yellow. Examples of red series colorants include red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet, lithol rubin GX, permanent red (F5R, FBB), brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, and oil orange. Examples of blue series colorants include cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chrome oxide, pyridian, emerald green, pigment green B, naphthol green B, green gold, acid green lake, malachite green lake, phthalocyanine green, and anthraquinone green. Examples of black series colorants include carbon black, oil furnace black, channel black, lamp black, acetylene black, azine dyes such as aniline black, metal salts of azo dyes, metal oxides, and composite metal oxides. Examples of other colorants include titania, zinc white, lithopone, nigrosine dyes, and iron black. These colorants, irrespective of the color, may be used singly or in combination of two or more kinds. The content of the colorant is usually 1 to 30 parts by weight, and preferably 3 to 20 parts by weight, relative to 100 parts by weight of the binding resin.

The toner may also include, if necessary, a charge control agent and the like. As such a charge control agent, conventionally known ones may be used, and examples thereof include nigrosine dyes, chromium-containing complexes, and quaternary ammonium salts. These charge control agents are used as distinguished in accordance with the polarity of the toner particles. Particularly, in the case of a color toner, colorless or light-colored agents that do not affect the color tone of the toner are preferred, and preferred examples include metal salts of salicylic acid, and metal salts of salicylic acid derivatives (Bontron E84, manufactured by Orient Chemical Co., Ltd.). The charge control agents exemplified above may be used singly or in combination of two or more kinds. The content of the charge control agent is preferably 0.5 to 8 parts by weight, and more preferably 1 to 5 parts by weight, relative to 100 parts by weight of the binding resin.

As the method for toner production, there are known a pulverization method, a polymerization method, an encapsulation method, and the like. An example of the pulverization method includes the following steps.

(1) A binding resin, a colorant, a charge control agent, a release promoting agent, a magnetic body and the like are sufficiently mixed by means of a mixing machine such as a Henschel mixer.

(2) The mixture is sufficiently kneaded by a batch-type two-roll mixer, a Banbury mixer, a continuous type twin-screw extruder, a continuous type single-screw kneading machine, or the like. Known examples of the continuous type twin-screw extruder include a KTK type twin-screw extruder manufactured by Kobe Steel, Ltd.; a TEM type twin-screw extruder manufactured by Toshiba Machine Co., Ltd.; a twin-screw extruder manufactured by KCK Co., Ltd.; a PCM type twin-screw extruder manufactured by Ikegai Tekko Co., Ltd.; and a KEX type twin-screw extruder manufactured by Kurimoto, Ltd. Known examples of the continuous type single-axis kneading machine include a Co-Kneader manufactured by Buss AG.

(3) After being cooled, the kneaded product is subjected to crude pulverization using a hammer mill or the like, and then to fine pulverization using a fine pulverizing machine which utilizes a jet stream, or a mechanical pulverizing machine. Subsequently, the pulverization product is classified into a predetermined particle size by a classifier which utilizes a swirling airflow, or a classifier which utilizes the Coanda effect, and thus mother particles are obtained.

An example of the polymerization method includes the following steps.

(1) A polymerizable monomer, a polymerization initiator (if necessary), a colorant, and the like are mixed and granulated in an aqueous dispersion medium.

(2) The granulated monomer composition particles are classified into appropriate particle sizes.

(3) Those monomer composition particles having a predefined particle size as obtained by the classification are subjected to a polymerization reaction.

(4) The dispersant is eliminated through an appropriate treatment, subsequently the polymerization product obtained by the polymerization reaction is filtered, washed with water and dried, and thus mother particles are obtained.

An example of the encapsulation method includes the following steps.

(1) A resin, a colorant and the like are kneaded with a kneading machine or the like, and thus a toner core material in a molten state is obtained.

(2) The toner core material is placed in water and strongly stirred, and thus a core material in the form of microparticles is produced.

(3) The core material microparticles are placed in a shell material solution, and while the shell material is stirred, a poor solvent is added dropwise thereto. Thus, the core material is encapsulated by covering the surface of the surface of the core material with the shell material.

(4) The capsules obtained thereby are filtered and then dried, and thus mother particles are obtained.

The toner may also contain another additive different from the additive described above. Such additive may be Teflon (registered trademark), zinc stearate, or polyvinylidene fluoride, which functions as a lubricating agent; cerium oxide, silicon carbide, or strontium titanate, which functions as a polishing agent; and zinc oxide, antimony oxide, or tin oxide, which functions as a conductivity imparting material.

As the magnetic carrier that is used as a developer, a conventionally known magnetic carrier may be used, which may be a powder having a magnetic property, such as an iron powder, a ferrite powder, or a nickel powder; or a glass bead. It is desirable to form a protective layer on the surface of these carriers by covering the surface with a resin or the like.

The resin used for the protective layer may be a polyfluorocarbon, a polyvinyl chloride, a polyvinylidene chloride, a phenolic resin, a polyvinyl acetal, an acrylic resin, or a silicone resin. An example of the method of forming a protective layer may be a method of coating the resin on the surface of the magnetic carrier by means of a spraying method, an immersion method or the like. The amount of use of the resin is preferably set at 1 to 10 parts by weight relative to 100 parts by weight of the magnetic carrier. The thickness of the protective layer is preferably 0.02 to 2 (μm), particularly preferably 0.05 to 1 (μm), and more preferably 0.1 to 0.6 (μm). If the protective layer is excessively thick, the fluidity of the carrier and the developer tends to decrease, and if the protective layer is excessively thin, the protective layer tends to be easily affected by film shaving over time, or the like.

It is preferable to use a magnetic carrier having a weight average particle size of 20 to 60 (μm). The mixing ratio of the toner and the magnetic carrier is appropriately about 0.5 to 7.0 parts by weight of the toner with respect to 100 parts by weight of the magnetic carrier.

The magnetic carrier used may be particles of a ferromagnetic substance, such as a metal like iron, nickel or cobalt; an alloy of any of these metals with another metal; an oxide such as magnetite, γ-hematite, chromium dioxide, copper-zinc ferrite, or manganese-zinc ferrite; and a Heusler alloy such as a manganese-copper-aluminum alloy. These particles of a ferromagnetic substance may be covered with a resin such as a styrene-acrylic resin, a silicone resin, or a fluororesin. It is desirable that the ferromagnetic material be appropriately selected in consideration of the chargeability of the toner containing a release promoting agent. The resin that is used to coat the particles of ferromagnetic substances may be mixed with a charge control agent, an electroconductive substance and the like. Furthermore, these magnetic particles dispersed in a styrene-acrylic resin, a polyester resin or the like may also be used. The intensity of saturation magnetization of the ferromagnetic substances is preferably 40 to 90 (emu/g). It is because, if the intensity is lower than 45 emu/g, the conveyability is lowered due to weak saturation magnetization, or deposition of the carrier to the photoconductor increases. On the other hand, if the intensity exceeds 90 (emu/g), the magnet brush or scavenging effect is intensified due to strong saturation magnetization, and scavenging marks are generated in the half-tone areas, lowering the image quality.

An example of the method for producing a magnetic carrier will be described below. First, materials listed in the following are provided.

Core Material

Cu—Zn ferrite particles (weight average diameter: 35 μm): 5000 parts by weight

Coating Material

Toluene: 450 parts by weight

Silicone resin SR2400 (manufactured by Dow Corning Toray Silicone Co., Ltd., non-volatile fraction 50%): 450 parts by weight Aminosilane SH6020 (manufactured by Dow Corning Toray Silicone Co., Ltd.): 10 parts by weight Carbon black: 10 parts by weight A mixture formed from the above-listed components including toluene and the like is stirred for 10 minutes with a stirrer, and thus a coating material is obtained. This coating material is fed into a coating apparatus which sprays while forming a swirling flow in a fluidized bed provided with a rotary bottom plate disk or a stirring blade, and the core material is coated with this coating material. The particles thus obtained are calcined in an electrical furnace at 250° C. for 2 hours, and thus a magnetic carrier having formed thereon a coating film with a thickness of about 0.5 (μm), is obtained.

Figure 4:
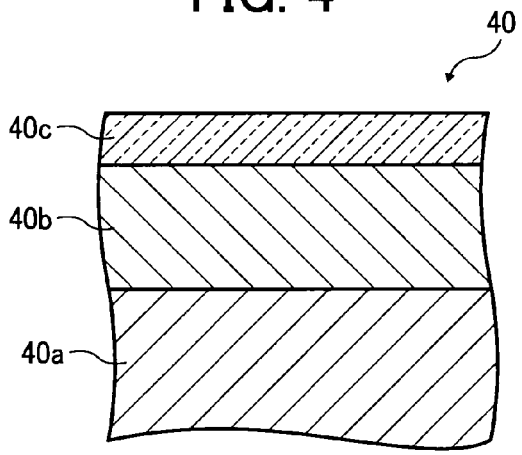
FIG. 4 is a schematic view for explaining a configuration of a photoconductor used as a latent image carrier illustrated in FIGS. 1 and 2.

Subsequently, the characteristic constitution of the photoconductor used in the copying machine of the instant Example will be explained. FIG. 4 is a magnified cross-sectional view showing the photoreceptive layer of the photoconductor. As described above, since the respective constitutions of the instruments in the process cartridge are the same, reference symbols Y, M, C and K will not be repeated in the following explanation. In the same figure, the photoconductor 40 has a photoreceptive layer coated on a conductive support that is not depicted. This photoreceptive layer is constituted to include, from the conductive support side toward the surface side, a charge generating layer 40*a*, a charge transport layer 40*b*, and filler-reinforced charge transport layer 40*c* coated thereon.

An example of the conductive support that can be used is a supported produced by coating a film-like or cylindrical-shaped plastic or paper with an electrically conductive substance having a volume resistance of $10^{10}$ (Ω·cm) or less, by vapor deposition or sputtering. The electrically conductive substance that is coated may be a metal such as aluminum, nickel, chromium, nichrome, copper, gold, silver, or platinum, or a metal oxide such as tin oxide or indium oxide. Furthermore, a tube produced not by coating an electrically conductive substance, but by forming a metal plate formed of aluminum, an aluminum alloy, nickel, stainless steel or the like into a cylindrical shape according to a technique such as extrusion or pultrusion, and then subjecting the cylindrically shaped metal plate to a surface treatment such as machining, super finishing or polishing, may also be used. The copying machine of the invention uses a drum-shaped photoconductor, but in the case of using a belt-shaped photoconductor, the endless nickel belt or endless stainless steel belt disclosed in Japanese Patent Application Laid-open No. S52-36016 may be used as the conductive support. In addition to these, an article obtained by dispersing an electrically conductive powder in an appropriate binding resin, and coating the dispersion on a support formed of a plastic or paper, may also be used. In this case, the electrically conductive powder may be carbon black, acetylene black; a powder of a metal such as aluminum, nickel, iron, nichrome, copper, zinc or silver; or a powder of a metal oxide such as electrically conductive tin oxide. Furthermore, the binding resin that is concurrently used may be a thermoplastic or thermosetting resin such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, a polyallylate resin, a phenoxy resin, polycarbonate, a cellulose acetate resin, an ethylcellulose resin, polyvinylbutyral, polyvinylformal, polyvinyltoluene, poly-N-vinyl carbazole, an acrylic resin, a silicone resin, an epoxy resin, a melamine resin, a urethane resin, a phenolic resin, or an alkyd resin; or a photocurable resin. The conductive layer formed on the support may be provided by dispersing such an electrically conductive powder and a binding resin in an appropriate solvent, for example, tetrahydrofuran, dichloromethane, methyl ethyl ketone or toluene, and applying the dispersion on the support. Furthermore, an article produced by providing a conductive layer on an appropriate cylindrical substrate using a thermally shrinkable tube which is produced by incorporating the electrically conductive powder into a material such as polyvinyl chloride, polypropylene, polyester, polystyrene, polyvinylidene chloride, polyethylene, chlorinated rubber or Teflon (registered trademark), may also be used as the electrical support.

The charge generating layer 40*a* of the photoreceptive layer contains a charge generating substance, a solvent and a binding resin as main components. The charge generating layer may further contain a binder resin, if necessary. Any kind of additive such as a sensitizer, a dispersant, a surfactant or a silicone oil may also be incorporated. As for the charge generating substance, any one of inorganic materials and organic materials can be used. Among these, the inorganic material may be crystalline selenium, amorphous selenium, selenium-tellurium, selenium-tellurium-halogen, selenium-arsenic compounds, or amorphous silicon. As the amorphous silicon, a product having the dangling bond terminated with a hydrogen atom or a halogen atom, or a product doped with a boron atom, a phosphorus atom or the like is adequately used. The organic material may be a phthalocyanine-based pigment such as metallophthalocyanine or a metal-free phthalocyanine; an azulenium salt pigment, a squaric acid methine pigment, an azo pigment having a carbazole skeleton, an azo pigment having a triphenylamine skeleton, an azo pigment having a diphenylamine skeleton, an azo pigment having a dibenzothiophene skeleton, an azo pigment having a fluorenone skeleton, an azo pigment having an oxadiazole skeleton, an azo pigment having a bis-stilbene skeleton, an azo pigment having a distyryl oxadiazole skeleton, an azo pigment having a distyryl carbazole skeleton, a perylene-based pigment, an anthraquinone-based or polycyclic quinone-based pigment, a quinoneimine-based pigment, a diphenylmethane- or triphenylmethane-based pigment, a benzoquinone- or naphthoquinone-based pigment, a cyanine- or azomethine-based pigment, an indigoid-based pigment, or a bisbenzimidazole-based pigment. These charge generating substances may be used singly or as a mixture of two or more thereof.

Examples of the binder resin that may be incorporated into the charge generating layer 40*a* as necessary, include polyamide, polyurethane, an epoxy resin, polyketone, polycarbonate, polyallylate, a silicone resin, an acrylic resin, polyvinylbutyral, polyvinylformal, polyvinyl ketone, polystyrene, poly-N-vinyl carbazole, and polyacrylamide. These binder resins may be used singly or as a mixture of two or more thereof. Furthermore, a polymeric charge transporting substance can also be used as the binder resin. Moreover, a low molecular weight charge transporting substance may also be added as necessary. Such low molecular weight transporting substances are classified into electron transporting substances and hole transporting substances, and these are further classified into low molecular weight-type charge transporting substances and macromolecular type charge transporting substances. Hereinafter, a macromolecular type charge transporting substance will be referred to as polymeric charge transporting substance.

Examples of the electron transporting substances include electron-accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. These electron transporting substances may be used singly or as a mixture of two or more thereof.

Examples of the hole transporting substances include oxazole, an oxadiazole derivatives, imidazole derivatives, triphenylamine derivatives, 9-(p-diethylaminostyrylanthracene), 1,1-bis-(dibenzylaminophenyl)propane, styrylanthracene, styrylpyrazoline, phenylhydrazones, an α-phenylstilbene derivative, a thiazole derivative, a triazole derivative, a phenazine derivative, an acridine derivative, a benzofuran derivative, a benzimidazole derivative, and a thiophene derivative. These hole transporting substances can be used singly or as a mixture of two or more thereof. Furthermore, polymeric charge transporting substances such as shown below may be used: a polymer having a carbazole ring, such as poly-N-vinyl carbazole; a polymer having a hydrazone structure as described in Japanese Patent Application Laid-open No. S57-78402; a polysilylene polymer as described in Japanese Patent Application Laid-open No. S63-285552; and a polymer having a triarylamine structure as described in Japanese Patent Application Laid-open No. H7-325409. These polymeric charge transporting substances may be used singly or as a mixture of two or more thereof.

As the method of forming the charge generating layer 40*a*, a method of producing a thin film in vacuum, or a method of casting from a solution dispersion system is known. The former method may be a vacuum deposition method, a glow discharge decomposition method, an ion plating method, a sputtering method, a reactive sputtering method, or a chemical vapor deposition (CVD) method, and these methods are able to satisfactorily form the inorganic materials and organic materials as described above. Furthermore, in the case of providing a charge generating layer according to a casting method, the charge generating layer may be formed in the manner such as described below, that is, an inorganic or organic charge generating substance described above is dispersed, together with a binder resin if necessary, in a solvent such as tetrahydrofuran, cyclohexanone, dioxane, dichloroethane or butanone, using a ball mill, an attriter, a sand mill or the like. Then, the dispersion liquid is appropriately diluted and coated. For this coating, an immersion coating method, a spraying coating method, a bead coating method or the like may be used.

The thickness of the charge generating layer 40*a* thus provided is suitably about 0.01 5 (μm), and preferably 0.05 to 2 (μm).

The charge transport layer 40*b* can be formed by dissolving or dispersing a mixture containing a charge transporting component and a binder component as main components, or a copolymer in an appropriate solvent, applying this solution or dispersion, and drying. A suitable thickness is about 5 to 50 (μm), and when a resolution power is required, a thickness of 5 to 30 (μm) is appropriate.

Examples of the binder component that is used in the charge transport layer 40*b* include the following polymer compounds: thermoplastic or thermosetting resins such as polystyrene, a styrene/acrylonitrile copolymer, a styrene/butadiene copolymer, a styrene/maleic anhydride copolymer, polyester, polyvinyl chloride, a vinyl chloride/vinyl acetate copolymer, polyvinyl acetate, polyvinylidene chloride, a polyallylate resin, polycarbonate, a cellulose acetate resin, an ethylcellulose resin, polyvinylbutyral, polyvinylformal, polyvinyltoluene, an acrylic resin, a silicone resin, a fluororesin, an epoxy resin, a melamine resin, a urethane resin, a phenolic resin, and an alkyd resin. These polymer compounds can be used singly or as a mixture of two or more thereof, or can be used in the form of a copolymer with a charge transporting substance.

The materials that can be used as the charge transporting substance include the low molecular weight type electron transporting substance, hole transporting substance, and polymer charge transporting substance described above. Furthermore, a low molecular weight compound such as an appropriate oxidation inhibitor, a plasticizer, a lubricating agent, an ultraviolet absorber, or a low molecular weight charge transporting substance, or a leveling agent may also be added to the charge transporting substance according to necessity. In the case of using a low molecular weight type charge transporting substance, the amount of use of this substance is preferably 20 to 200 parts by weight, and more preferably about 50 to 100 parts by weight, relative to 100 parts by weight of the polymer compound. Furthermore, when a polymeric charge transporting substance is used, a material formed by copolymerizing 100 parts by weight of the charge transporting component with about 0 to 500 parts by weight of the resin component, is used with preference.

The dispersing solvent used for preparing a charge transport layer coating liquid may be a ketone such as methyl ethyl ketone, acetone, methyl isobutyl ketone, or cyclohexanone; an ether such as dioxane, tetrahydrofuran, or ethylcellosolve; an aromatic hydrocarbon such as toluene or xylene; a halogenated hydrocarbon such as chlorobenzene or dichloromethane; and an ester such as ethyl acetate or butyl acetate.

These compounds may be used singly or as a mixture of two or more thereof. The amount of use of the low molecular weight compounds is suitably 0.1 to 200 parts by weight, preferably 0.1 to 30 parts by weight, relative to 100 parts by weight of the polymer compounds, and the amount of use of the leveling agent is suitably about 0.001 to 5 parts by weight relative to 100 parts by weight of the polymer compound.

The filler-reinforced charge transport layer 40*c* includes at least a charge transporting component, a binder resin component and a filler, and exhibits charge transporting properties as well as mechanical durability. This filler-reinforced charge transport layer also functions as a surface layer among the layers obtainable when the charge transport layer mentioned above is functionally separated into two or more layers.

Examples of the filler material used in the filler-reinforced charge transport layer 40*c* include an inorganic material, silica, titanium oxide, and alumina. These materials may be used as a mixture of two or more thereof. The filler material may be subjected to surface modification using a surface treating agent, in order to promote an enhancement of the dispersibility of the filler material in the coating liquid and the coated film. The filler material can be dispersed in a solvent mixed with a charge transporting substance, a binding resin or the like, using an appropriate dispersing machine. Furthermore, it is preferable that the average primary particle size of the filler material be 0.01 to 0.8 (μm), in view of the transmittance or abrasion resistance of the charge transport layer. As the method of coating a solution containing a filler material dispersed therein, an immersion method, a spray coating method, a ring coating method, a roll coating method, a gravure coating method, a nozzle coating method, a screen printing method, or the like may be used. The thickness of the filler-reinforced charge transport layer 40*c* is preferably 0.5 (μm) or greater, and more preferably 2 (μm).

A subbing layer may also be provided between the conductive support and the photoreceptive layer. This subbing layer generally contains a resin as a main component. In regard to this resin, upon considering that the resin is dispersed in a solvent and applied on the charge transport layer 40*b* in the form of a dispersion liquid, it is desirable to use a resin having high solvent resistance against general organic solvents. Such a resin may be a water-soluble resin such as polyvinyl alcohol, casein, or polyacrylic acid sodium; an alcohol-soluble resin such as copolymerized nylon, or methoxymethylated nylon; or a curable resin that forms a three-dimensional network structure, such as polyurethane, a melamine resin, a phenolic resin, an alkyd-melamine resin, or an epoxy resin.

As the subbing layer, a finely powdered pigment of a metal oxide such as titanium oxide, silica, alumina, zirconium oxide, tin oxide or indium oxide may be added to the subbing layer, so as to promote the suppression of moire or lowering of the residual potential. Furthermore, a silane coupling agent, a titanium coupling agent, a chromium coupling agent, or the like can also be used. In addition to these, a film provided by anodizing $Al_2O_3$, or a film provided by subjecting an organic substance such as poly-para-xylene (Parylene), or an inorganic substance such as $SiO_2$, $SnO_2$, $TiO_2$, ITO, or $CeO_2$ to a vacuum thin film fabrication method, can be used. The thickness of the subbing layer is suitably 0 to 20 (μm), and preferably 1 to 10 (μm).

The respective layers described thus far may further contain an oxidation inhibitor, a plasticizer, a lubricating agent, an ultraviolet absorber, a low molecular weight charge transporting substance, or a leveling agent, for the purpose of improving the environment resistance, and particularly preventing a decrease in sensitivity and an increase in the residual potential.

The oxidation inhibitor addable to the layers may be any of the following.

(a) Phenolic Compound

For example, 2,6-Di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylenebis(4-methyl-6-t-butylphenol), 2,2'-methylenebis(4-ethyl-6-t-butylphenol), 4,4'-thiobis-(3-methyl-6-t-butylphenol), 4,4'-butylidenebis(3-methyl-6-t-butylphenol), 1,1,3-tris(2-methyl-4-hydroxy-5-t-butylphenyl)butane, 1,3,5-trimethyl-2,4,6-tris(3,5-di-t-butyl-4-hydroxybenzyl)benzene, tetrakis [methylene-3-(3',5'-di-t-butyl-4'-hydroxyphenyl) propionate] methane, bis[3,3'-bis(4'-hydroxy-3'-t-butylphenyl)butyric acid] glycol ester, tocopherols, or the like may be used.

(b) Para-phenylenediamine

For example, N-phenyl-N'-isopropyl-p-phenylenediamine, N,N'-di-sec-butyl-p-phenylenediamine, N-phenyl-N-sec-butyl-p-phenylenediamine, N,N'-diisopropyl-p-phenylenediamine, N,N'-dimethyl-N,N'-di-t-butyl-p-phenylenediamine, or the like may be used.

(c) Hydroquinone

For example, 2,5-Di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, or the like may be used.

(d) Organic Sulfur Compounds

For example, dilauryl-3,3'-thiodipropionate, distearyl-3,3'-thiodipropionate, ditetradecyl-3,3'-thiodipropionate, or the like may be used.

(e) Organic Phosphorus Compound

For example, triphenylphosphine, tri(nonylphenyl)phosphine, tri(dinonylphenyl)phosphine, tricresylphosphine, tri(2,4-dibutylphenoxy)phosphine, or the like may be used.

The plasticizer addable to the layers may be any of the following.

(a) Phosphoric Ester-based Plasticizer

For example, triphenyl phosphate, tricresyl phosphate, trioctyl phosphate, octyl diphenyl phosphate, trichloroethyl phosphate, cresyl diphenyl phosphate, tributyl phosphate, tri-2-ethylhexyl phosphate, triphenyl phosphate, or the like may be used.

(b) Phthalic Ester-based Plasticizer

For example, dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl phthalate, octyl decyl phthalate, dibutyl fumarate, dioctyl fumarate, or the like may be used.

(c) Aromatic Carboxylic Acid Ester-based Plasticizer

For example, trioctyl trimellitate, tri-n-octyl trimellitate, octyl oxybenzoate, or the like may be used.

(d) Aliphatic Dibasic Acid Ester-based Plasticizer

For example, dibutyl adipate, di-n-hexyl adipate, di-2-ethylhexyl adipate, di-n-octyl adipate, n-octyl n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, or the like may be used.

(e) Fatty Acid Ester Derivative

Butyl oleate, glycerin monooleate ester, methyl acetylricinolate, pentaerythritol ester, dipentaerythritol hexaester, triacetin, tributyrin, or the like may be used.

(f) Oxyacid Ester-based Plasticizer

Methyl acetylricinolate, butyl acetylricinolate, butyl phthalylbutyl glycolate, tributyl acetylcitrate, or the like may be used.

(g) Epoxy Plasticizer

Epoxidated soybean oil, epoxidated linseed oil, butyl epoxystearate, decyl epoxystearate, octyl epoxystearate, benzyl epoxystearate, dioctyl epoxyhexahydrophthalate, didecyl epoxyhexahydrophthalate, or the like may be used.

(h) Dihydric Alcohol Ester-based Plasticizer

Diethylene glycol dibenzoate, triethylene glycol di-2-ethyl butyrate, or the like may be used.

(i) Chlorine-containing Plasticizer

Chlorinated paraffin, diphenyl chloride, chlorinated fatty acid methyl, methoxychlorinated fatty acid methyl, or the like may be used.

(j) Polyester-based Plasticizer

Polypropylene adipate, polypropylene sebacate, polyester, acetylated polyester, or the like may be used.

(k) Sulfonic Acid Derivative

For example, p-toluene sulfonamide, o-toluene sulfonamide, p-toluene sulfone ethylamide, o-toluene sulfone ethylamide, toluene sulfone-N-ethylamide, p-toluene sulfone-N-cyclohexylamide, or the like may be used.

(l) Citric Acid Derivative

Triethyl citrate, triethyl acetylcitrate, tributyl citrate, tributyl acetylcitrate, tri-2-ethylhexyl acetylcitrate, n-octyldecyl acetylcitrate, or the like may be used.

(m) Other

Terphenyl, partially hydrogenated terphenyl, camphor, 2-nitrodiphenyl, dinonylnaphthaline, methyl abietate, or the like may used.

The lubricating agent addable to the layers may be any of the following.

(a) Hydrocarbon-based Compound

Liquid paraffin, paraffin wax, microcrystalline wax, oligomeric polyethylene, or the like may be used.

(b) Fatty Acid-based Compound

Lauric acid, myristic acid, palmitic acid, stearic acid, arachidic acid, behenic acid, or the like may be used.

(c) Fatty Acid Amide-based Compound

Stearylamide, palmitylamide, oleylamide, methylene bisstearamide, ethylene bisstearamide, or the like may be used.

(d) Ester-based Compound

A lower alcohol ester of a fatty acid, a polyhydric alcohol ester of a fatty acid, a fatty acid polyglycol ester, or the like may be used.

(e) Alcohol-based Compound

Cetyl alcohol, stearyl alcohol, ethylene glycol, polyethylene glycol, polyglycerol, or the like may be used.

(f) Metal Soap

Lead stearate, cadmium stearate, barium stearate, calcium stearate, zinc stearate, magnesium stearate, or the like may be used.

(g) Natural Wax

Carnauba wax, candelilla wax, beeswax, spermaceti wax, Chinese wax, montan wax, or the like may be used.

(h) Other

A silicone compound, a fluorine compound, or the like may be used.

The ultraviolet absorber addable to the layers may be any of the following.

(a) Benzophenone

For example, 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, or the like may be used.

(b) Salicylate

Phenyl salicylate, 2,4-di-t-butylphenyl 3,5-di-t-butyl-4-hydroxybenzoate, or the like may be used.

(c) Benzotriazole

For example, (2'-hydroxyphenyl)benzotriazole, (2'-hydroxy-5'-methylphenyl)benzotriazole, (2'-hydroxy-5'-methylphenyl)benzotriazole, (2'-hydroxy-3'-tertiary-butyl-5'-methylphenyl)-5-chorobenzotriazole, or the like may be used.

(d) Cyanoacrylate

Ethyl-2-cyano-3,3'-diphenyl acrylate, methyl 2-carbomethoxy-3-(paramethoxy)acrylate, or the like may be used.

(e) Quencher (Metal Complex Salt)

Nickel (2,2'-thiobis(4-t-octyl)phenolate) normal-butylamine, nickel dibutyldithiocarbamate, nickel dibutyldithiocarbamate, cobalt dicyclohexyldithiophosphate, or the like may be used.

(f) HALS (Hindered Amine)

Bis(2,2,6,6-tetramethyl-4-piperidyl) sebacate, bis(1,2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, or the like may be used.

In FIG. 3, the copy machine according to the present embodiment includes a developing bias power source (not shown) as a developing bias applying means that applies a developing bias to the developing sleeve 65 of the developing device 61. The copy machine according to the present embodiment further includes a charging bias power source (not shown) as a charging bias applying means that applies a charging bias to the charging roller as a rotary charging member of the charging device 60. Of these power sources, the developing bias power source is configured to supply a direct current (DC) developing bias including only a DC component to the developing sleeve 65. The charging bias power source is configured to supply an alternating current (AC) charging bias including at least an AC component to the charging roller. The present copy machine employs a combination of charging of an AC method and development of a DC method.

Such a configuration can prevent the photoconductor 40 from deteriorating due to the scrape of the filler reinforced charge transport layer 40C as illustrated in FIG. 4.

Figure 5:
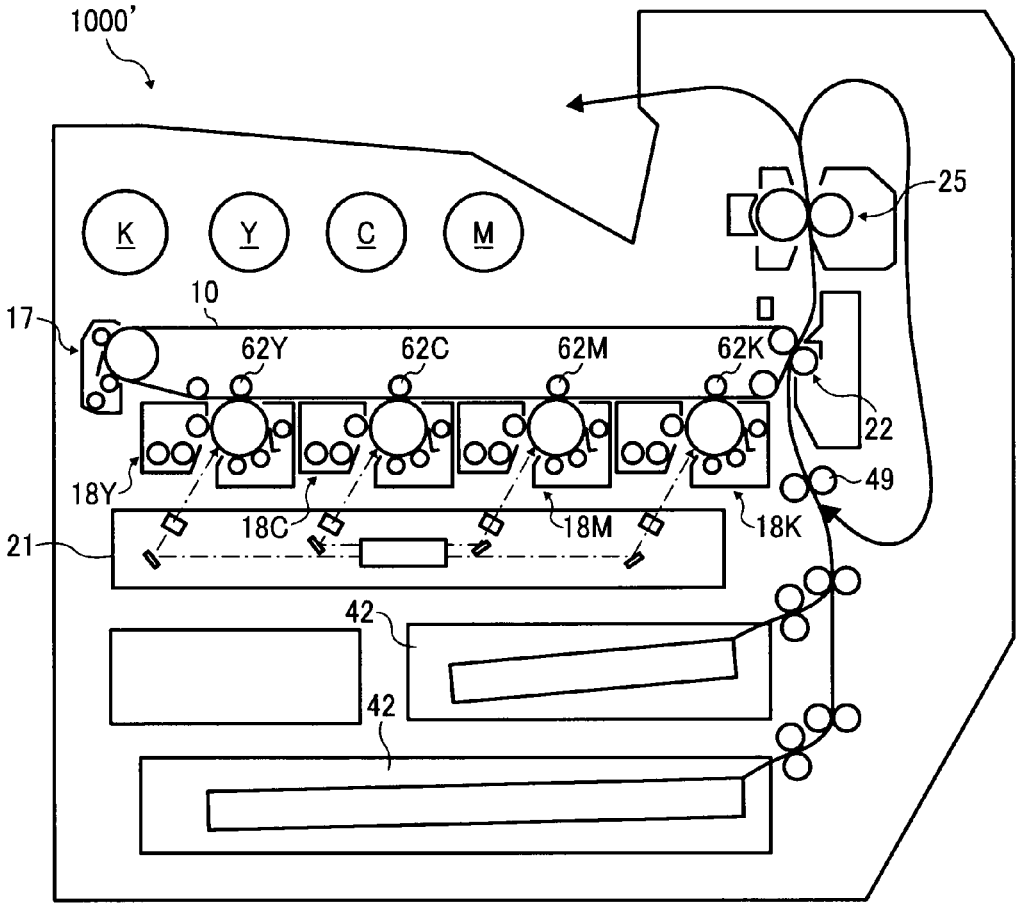
FIG. 5 is a schematic view for explaining a configuration that is partially different from the image forming apparatus illustrated in FIG. 1.

As a configuration different from the image forming apparatus illustrated in FIG. 1, a configuration illustrated in FIG. 5 may be used.

Unlike the copy machine such as the image forming apparatus illustrated in FIG. 1, the image forming apparatus illustrated in FIG. 5 (for convenience, designated as 1000') does not include the automatic document feeder device (document scanner) 400 and corresponds to, for example, a printer in which printing is performed in response to image information from a computer or a facsimile machine in which printing is performed using an image information signal from a communication line. Further, arrangement configurations of the optical writing unit 21 and a structure of recirculating the transfer sheet after fixing are different. Due to such a configuration, an installation space of a toner replenishing tank (designated as K, Y, C, and M in FIG. 5) for the developing device below a paper discharge base is secured. Further, in FIG. 5, in a part of the configuration, the same members as in FIG. 1 are designated as the same reference numerals.

Features of the invention will be described below in connection with the image forming apparatus having such a configuration.

Figure 22:
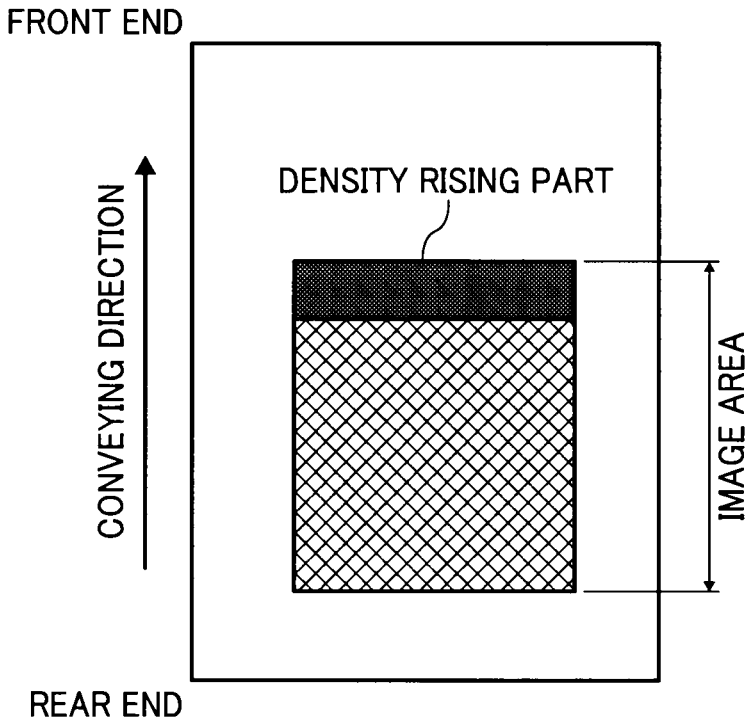
FIG. 22 is a view for explaining an area in which density deviation occurs.

As described in the background art, when the developing part (the image part) reaches the developing position directly after the non-developing part (the non-image part), there is a problem in that density of the image part front end in the image transferred onto the recording material becomes high as illustrated in FIG. 22. Therefore, the invention is devised to resolve the problem.

In the invention, in order to resolve the problem, according to the length of the non-image part directly before the image part in the image carrier moving direction, for a predetermined length, in the image carrier moving direction, corresponding to an area in which density increases from the image front end in the developing part, in other words, an area in which density deviation occurs, the toner attachment amount on the recording material is controlled to reduce the attachment amount when the density is higher compared to the toner attachment amount in the typical control.

In this case, toner attachment amount control in typical control means attachment amount control in a state in which control of reducing the attachment amount is not performed when image forming of the same density is performed, that is, toner attachment control that is performed in a part excluding a predetermined length from the image front end when an image having a solid image behind the non-image part that satisfies Equation 1 is formed.

In below description, the image carrier in expression of the image carrier moving direction is based on both or either of the photoconductor and the transfer body that can carry a transfer image.

In the invention, an exposure amount, a developing bias, or a transfer bias in which a toner attachment amount for a standard image is obtained is controlled based on a predetermined length in the image carrier moving direction according to a length of the non-image part directly before the image part in the image carrier moving direction. Accordingly, density deviation in the image front end transferred on the recording material is suppressed, and an abnormal image in which the density in the image front end transferred on the recording material is different the standard image is prevented from being created.

Concrete examples will be described below.

In the invention, when a length Lg of the non-image part directly before the image part in the image carrier moving direction satisfies a relationship of Equation 1 below, control contents of one or more of the exposure condition, the developing bias, and the transfer bias on the image carrier are changed.

As a result, for a predetermined length from the image front end on the photoconductor in the image carrier moving direction, control is performed so that toner attachment is suppressed further than in the toner attachment amount control in typical control described above, whereby the toner attachment amount of the image front end in the image on the recording material is suppressed.

In Equation 1, the length Lg of the non-image part directly before the image part is obtained by computing a distance from a front end edge of the recording material in the moving direction to an image forming start position based on image information.

$$Lg \geq \pi \cdot Ds/(Vs/Vp) \quad (1)$$

An occurrence tendency of density deviation in which density in the image part front end is different from a target value is different according to a combination of image patterns having points in which an image pattern changes as a boundary. For example, when a difference of image density or an area rate in portions ahead of and behind points in which the image patterns changes is large, the density deviation is relatively large, and otherwise the density deviation is relatively small. Further, the density deviation is affected by an order in which the image patterns changes. For example, the degree of density deviation or the occurrence tendency of deviation (a case where density becomes thicker or thinner) is different when a pattern having high image density changes to a pattern having low image density from when a pattern having low image density changes to a pattern having high image density.

Therefore, in the invention, for a predetermined length from the image front end in the image carrier moving direction, the image forming condition is decided based on the occurrence tendency of the density deviation.

In this case, as the image forming conditions, (1) the exposure condition, (2) the developing bias condition, and (3) the transfer bias are used as described above.

Even a case of using any of these conditions aims to adjust the toner attachment amount in the predetermined length from the image front end on the recording material in the recording material moving direction by controlling the amount of the toner attached to the recording material.

First, (1) the exposure condition will be described.

The exposure condition includes at least one of an exposure amount, exposure energy (exposure power), or exposure time. When the relationship of Equation (1) is satisfied, control is performed so that the toner attachment amount in the predetermined length, in the image carrier moving direction, from the image front end at the image carrier side is smaller than in the standard image.

Control of the exposure condition described below is performed to set the exposure amount so that the toner attachment amount on the image carrier in an area in the predetermined length, in the image carrier moving direction, from the image front end in the image part is smaller than in typical control, based on the number of times that the developing sleeve passes through the non-image part in view of the fact that the toner attachment amount increases due to the development history as the number of times that the developing sleeve passes through the non-image part increases. As a result, the toner attachment amount on the recording material is adjusted.

In this case, based on the length Lg(m) of the non-image part directly before the image part, the exposure amount P(J/m$^2$) of the image part front end, and the exposure amount Pdef((J/m$^2$)) of the standard image part, a predetermined length L from the image part front end in the image carrier moving direction is computed by Equation 2 below, and then the number of times that the developing sleeves the non-image part is computed by Equation 3.

The predetermined length L from the image part front end in the image carrier moving direction obtained by Equation 2 corresponds to one round of the developing sleeve. As described above, as the number of times that the developing sleeve passes through the non-image part increases, the toner attachment amount increases due to the development history. Therefore, because the density deviation occurs even in the length of one or more rounds, a coefficient n (n is an integer equal to or more than 1) is multiplied.

$$L = n\pi \cdot Ds/(Vs/Vp) \quad (2)$$

$$Lg/n(\pi Ds/(Vs/Vp) \quad (3)$$

Based on the number of times that the developing sleeves passes through obtained by Equation 3, the exposure amount P (J/m$^2$) set for the standard image (an image part excluding a predetermined length from the image front end of the image part in the image carrier moving direction) is controlled as in Table 1.

Coefficients α1 to α3 used as control amounts of the exposure amount shown in Table 1 are real numbers equal to or more than 0 and equal to or less than 1. The exposure amount for obtaining the result shown in Table 1 is adjusted by changing the exposure time. Further, the exposure amount may be adjusted based on the exposure energy (the exposure power).

TABLE 1

| Lg/(π · Ds/(Vs/Vp) | Equal to or more than 1 and less than 2 | Equal to or more than 1 and less than 2 | Equal to or more than 3 |
|---|---|---|---|
| P(J/m$^2$) | Pdef × α1 | Pdef × α2 | Pdef × α3 |

α is equal to or more than 0 and equal to or less than 1

In control shown in Table 1, all of the non-image parts at the image part front end side are defined as areas of the non-image part with respect to the photoconductor axial direction (the direction perpendicular to the paper transport direction). Further, the length of the non-image part at the image part front end side may be computed for each of the predetermined length in the photoconductor axial direction. In this case, the computed load increases but can be more finely controlled. Further, in the present embodiment, for Lg/(πDs(Vs/Vp) that is Equation (3), discrete control is performed, but continuous control may be performed.

The inventor(s) of the present application performed control having the conditions shown in Table 1 on image patterns in which the non-image part is present throughout the photoconductor axial direction (the direction perpendicular to the transfer sheet transport direction), in other words, the main scanning direction and the image part is present directly after the non-image part throughout the main scanning direction and obtained the result shown in Table 2.

Further, in the result shown in Table 2, α1 to α3 as exposure control parameters have the same value. Further, Table 2 shows a case in which the exposure control is not performed as a comparative example.

As can be seen from the result of Table 2, when the exposure control was not performed on a predetermined length from the image front end in the image carrier moving direction, the density of the almost same area became thicker in about 40 mm from the image front end, that is, the length L on the photoconductor that contacts one round of the developing sleeve, in other words, L=Ds/(Vs/Vp)=78.5/2=39.25 mm computed by Equation (2). However, when the exposure control was performed with the exposure amount smaller than typical control on the predetermined length from the image part in the image carrier moving direction, a density difference ΔID between the image part and parts other than the front end was reduced. Further, X-Lite (available from AMTEC corporation) was used for density measurement. Further, the result shown in Table 5 was based on the following condition.

Photoconductor circumferential velocity Vp: 245 [mm/s]

Developing sleeve diameter Ds: 25 [mm] (developing sleeve circumferential length πDs≅78.5[mm])

Developing sleeve circumferential velocity Vs: 490 [mm/s] (a circumferential velocity ratio Vs/Vp between the developing sleeve and the photoconductor is 2.0)

Photoconductor charge potential: −600 [V]

Developing sleeve applying bias: −500 [V]

Exposure amount Pdef of the standard image part: 0.263 [mJ/m$^2$)

Exposure amount control parameter: α1=α2=α3=0.97

TABLE 2

| | | Non-image part area length [mm] | | | |
|---|---|---|---|---|---|
| | | 40 | 80 | 120 | 160 |
| | The number of times of passing through the non-image part (Lg/(π · Ds/(Vs/Vp)) | (1.02) | (2.04) | (3.06) | (4.08) |
| | Exposure amount P [mJ/m$^2$] | 0.255 | | | |
| ΔID | exposure amount control | 0.006 | 0.010 | 0.013 | 0.014 |
| | no exposure amount control | 0.025 | 0.030 | 0.033 | 0.032 |

Next, a result of changing the exposure control parameters α1 to α3 to the following condition and similarly outputting an image is shown in Table 3. Table 3 shows a result of a density difference ΔID between the image part front end and parts other than the front end. As can be seen from the result of Table 3, the density difference is further reduced compared to the above-described condition. Further, the exposure amount control parameters are set as follows: α1=0.97, α2=0.95, and α3=0.94.

TABLE 3

| | | Non-image part length [mm] | | | |
|---|---|---|---|---|---|
| | | 40 | 80 | 120 | 160 |
| | The number of times of passing through the non-image part (Lg/(π · Ds/(Vs/Vp)) | (1.02) | (2.04) | (3.06) | (4.08) |
| | Exposure amount P [mJ/m$^2$] | 0.255 | 0.250 | 0.247 | 0.247 |
| ΔID | Exposure amount control | 0.006 | 0.003 | 0.005 | 0.003 |
| | No Exposure amount control | 0.025 | 0.030 | 0.033 | 0.032 |

In the exposure amount control described above, as the number of times that the developing sleeve passes through the non-image part, the development history increases. Therefore, the toner attachment amount on the photoconductor is adjusted in the predetermined length, in the image carrier moving direction, from the image front end that reaches the developing sleeve directly after the non-image part, and particularly, control on the toner attachment amount on the photoconductor is performed to suppress the attachment amount further than typical control described above. Therefore, the toner density in the image front end is prevented from increasing, thereby preventing the density deviation occurring in the image front end on the recording material.

However, in the invention, unlike a case in which the same image patterns are formed in the photoconductor axial direction, that is, in the main scanning direction as described above, even in the case in which the image patterns are non-uniformly formed in the main scanning direction, similarly to the above-described embodiment, control of suppressing the toner attachment amount on the recording material is performed on the predetermined length from the image front end in the image carrier moving direction, thereby preventing the density deviation, which will be described below.

Figure 7A:
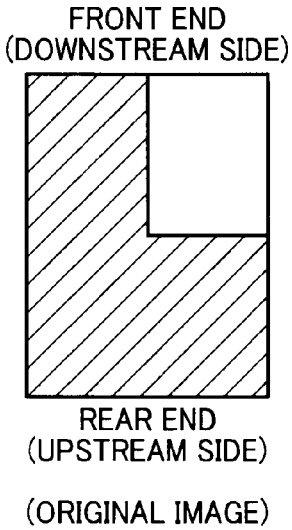
FIGS. 7A to 7E are views illustrating occurrence states of density deviation of image patterns when control using an exposure condition is performed on a predetermined area divided in an axial direction of an image carrier and when the control is not performed, compared to an original image.
Figure 7B:
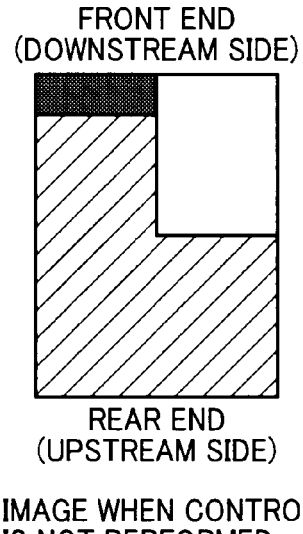
Figure 7C:
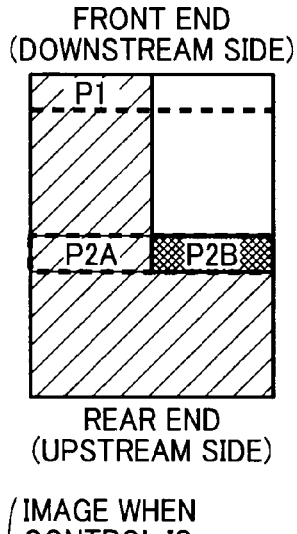
Figure 7D:
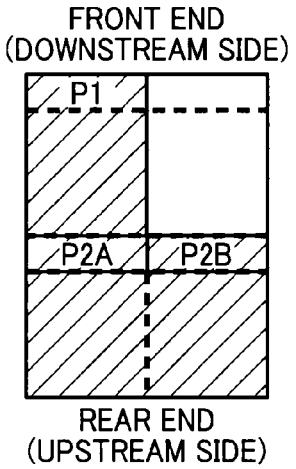

FIGS. 7A to 7E illustrate cases in which the image front end positions are different in the main scanning direction, that is, the image patterns are non-uniformly formed. FIG. 7A illustrates a document image to be output from a printer, FIG. 7B illustrates a case in which control of the invention is not performed, FIG. 7C illustrates a case in which control of the invention is performed on the most front end of the image front end, and FIG. 7D illustrates a case in which control of the invention is performed on the front end of each image divided in the main scanning direction.

In FIGS. 7A to 7D, when control using, for example, the exposure amount as the control condition on the predetermined length from the image front end in the image carrier moving direction is not performed, as illustrated in FIG. 7B, similarly to the conventional art, the density deviation occurs in the image front end.

However, when control of reducing the exposure amount in the predetermined length from the image front end in the image carrier moving direction is performed on an image positioned at a downstream side among images having the front end at the upstream side and the downstream side in the recording material transport direction, that is, an image having an image front end after an image at the most front end in the recording material conveying direction, as illustrated in FIG. 7C, the density deviation is suppressed on the predetermined length, in the image carrier moving direction, from the image front end of the most front end image designated as P1 among a plurality of image patterns. However, since the predetermined length, in the image carrier moving direction, from the image front end of the most front end image is set as a target area in which the density deviation is suppressed, control on the predetermined length, in the image carrier moving direction, from the image front end that is present at a position designated as P2B is not performed on an image having an image front end behind the most front end image. For this reason, an image having an image front end behind the most front end image is maintained in a state in which the density deviation is not suppressed on the predetermined length, in the image carrier moving direction, from the image front end.

Therefore, when control of reducing the exposure amount is performed on the image having the image front end behind the most front end similarly to the front end image, as illustrated in FIG. 7D, the occurrence of the density deviation in the predetermined length (a part designated as P2B in FIG. 7D), in the image carrier moving direction, from the front end of the image having the image front end behind the most front end is suppressed. However, at the most front end image side (an area designated as P2A) corresponding to the predetermined length, a part having thin density occurs, leading to the density deviation.

In the invention, for each of a plurality of image patterns formed on areas divided in the main scanning direction, when the length Lg of the image carrier moving direction of the non-image part directly ahead of the image part has the relationship of Equation 1 for each divisional area similarly to the above-described embodiment, the exposure amount in the predetermined length from the image front end in the image carrier moving direction is controlled for each divisional image in the axial direction of the image carrier.

Figure 7E:
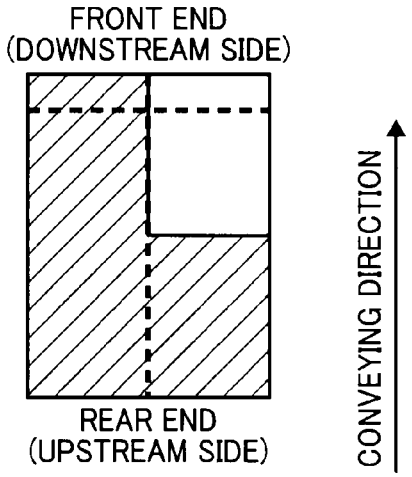

As described above, when the image pattern that is divided in the main scanning direction and formed in a state in which the image front end position is non-uniform is present, attachment amount control of the toner as the image carrier is performed through control of suppressing the toner attachment, for each divisional area, based on the length of the image carrier moving direction of the non-image part directly ahead of the image part. Therefore, as illustrated in FIG. 7E, for each image of each divisional area, the density deviation in the image part front end is suppressed, and the density in the image front end transferred on the recording material is prevented from becoming thicker.

Figure 8:
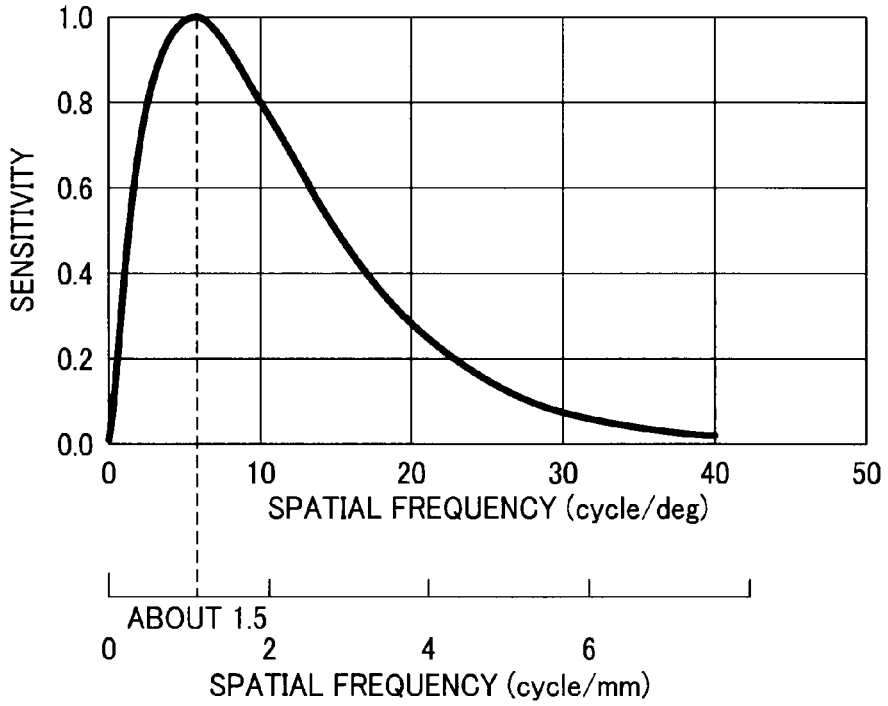
FIG. 8 is a diagrammatic view for explaining a reason of considering influence of a visual feature when exposure condition control is performed in a density deviation occurrence area.

In the present embodiment, as the length of the control target area in the main scanning direction that is the control target in which the density deviation is suppressed on the image area divided in the main scanning direction (the length in the direction perpendicular to the moving direction of the image carrier or the recording material), the length of the exposure amount control area, that is, as illustrated in FIG. 8, the length of the predetermined area in the main scanning direction is set less than ⅔ mm in view of the fact that there is sensitivity that is likely to be recognized in 1.5 cycle/mm (⅔ mm cycle) in a human visual feature.

Figure 9A:
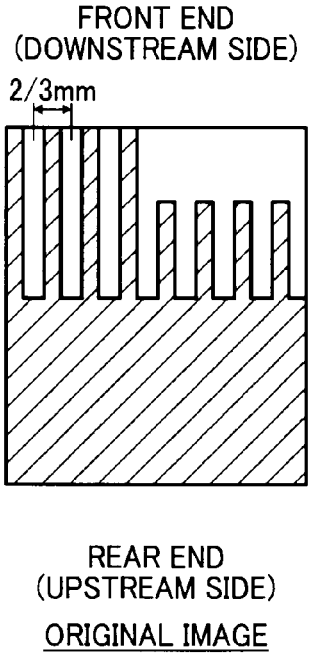
FIGS. 9A to 9C are views for comparing effects of resolving density deviation by selecting a length of a predetermined area in the case of targeting the predetermined area illustrated in FIGS. 7A to 7E.
Figure 9B:
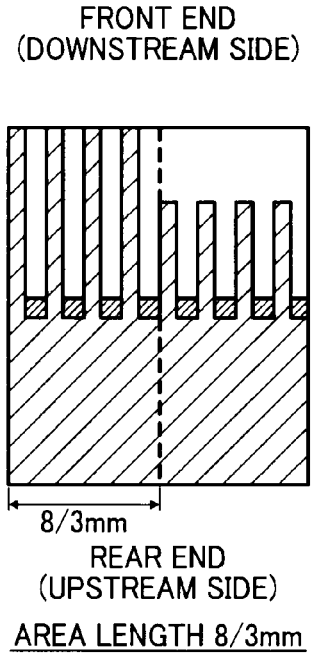
Figure 9C:
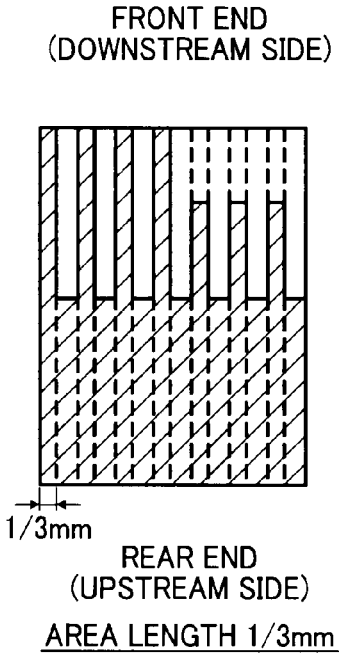

FIGS. 9A to 9C illustrate cases in which image patterns divided in the main scanning direction and having different image front ends are different in the length of the control target area. FIG. 9A illustrates an original image, FIG. 9B illustrates a case in which the length of the predetermined area is ⅔ mm, that is, is not less than ⅔ mm, and FIG. 9C illustrates a case in which the length of the predetermined area is ⅓ mm, that is, is less than ⅔ mm.

As can be seen from FIGS. 9A to 9C, compared to the state illustrated in FIG. 9B, when the length of the control target area in the main scanning direction, that is, the width of the control area is reduced, a part in which the density deviation occurs can be reduced and thus invisible.

Next, details of control on the developing bias will be described.

Since the developing bias affects the toner attachment amount on the photoconductor, in the present embodiment, control shown in Table 4 is performed based on the same condition as the results of Tables 2 and 3 are obtained.

The condition shown in Table 4 is based on the number of times that the developing roller passes through the non-image part similarly to the above-described case. Coefficients z1 to z3 depending on the number of times are used as control parameters of developing bias control, and the developing bias (Vc) for the standard image part is multiplied by the coefficients z1 to z3.

TABLE 4

| The number of times that the developing roller passes through the non-image part $Lg/(\pi \cdot Ds/(Vs/Vp))$ | Equal to or more than 1 and less than 2 | Equal to or more than 1 and less than 2 | Equal to or more than 3 |
|---|---|---|---|
| Vc [V] | Vc × z1 | Vc × z2 | Vc × z3 |

Z is a real number equal to or more than zero (0).

The inventor(s) of the present application performed control having the conditions shown in Table 4 on image patterns in which the non-image part is present throughout the photoconductor axial direction (the direction perpendicular to the transfer sheet transport direction), in other words, the main scanning direction and the image part is present directly behind the non-image part throughout the main scanning direction and obtained the result shown in Table 5. Further, in the result shown in Table 5, z1 to z3 as the developing bias parameters have the same value (z1=z2=z3=0.96). Further, Table 5 shows a case in which the developing bias control is not performed as a comparative example.

As can be seen from the result of Table 5, when the developing bias control was not performed, the density of the same area became thicker in about 40 mm from the image front end, that is, the length on the photoconductor that contacts one round of the developing sleeve, in other words, L=Ds/(Vs/Vp)=78.5/2=39.25 mm computed by Equation (2). However, when the developing bias control was performed, a density difference ΔID between the image part and parts other than the front end was reduced. Further, X-Lite (available from AMTEC corporation) was used for density measurement. Further, the result shown in Table 5 is based on the following condition.

Photoconductor circumferential velocity Vp: 245 [mm/s]

Developing sleeve diameter Ds: 25 [mm] (developing sleeve circumferential length πDs≅78.5 [mm])

Developing sleeve circumferential velocity Vs: 490 [mm/s] (a circumferential velocity ratio Vs/Vp between the developing sleeve and the photoconductor is 2.0)

Photoconductor charge potential: −600 [V]

Developing sleeve applying bias: −500 [V]

Developing bias control parameter: z1=z2=z3=0.96

TABLE 5

| | | Non-image part area length [mm] | | | |
|---|---|---|---|---|---|
| | | 40 | 80 | 120 | 160 |
| The number of times of passing through the non-image part (Lg/(π · Ds/(Vs/Vp)) | | (1.02) | (2.04) | (3.06) | (4.08) |
| Developing bias Potential Vc [V] | | | −480 | | |
| ΔID | Developing bias control | 0.005 | 0.009 | 0.012 | 0.013 |
| | no developing bias control | 0.025 | 0.029 | 0.032 | 0.033 |

Next, a result of changing the developing bias control parameters z1 to z3 to the following condition and similarly outputting an image is shown in Table 6. Table 6 shows a result of a density difference ΔID between the image part front end and parts other than the front end. As can be seen from the result of Table 6, the density difference is further reduced compared to the above-described condition. Further, the developing bias control parameters are set as follows: z1=0.96, z2=0.95, and z3=0.94.

TABLE 6

| | | Non-image part length [mm] | | | |
|---|---|---|---|---|---|
| | | 40 | 80 | 120 | 160 |
| The number of times of passing through the non-image part (Lg/(π · Ds/(Vs/Vp)) | | (1.02) | (2.04) | (3.06) | (4.08) |
| Developing bias potential Vc [V] | | −480 | −474 | −471 | −471 |
| ΔID | Developing bias control | 0.005 | 0.003 | 0.004 | 0.003 |
| | No developing bias control | 0.025 | 0.029 | 0.032 | 0.033 |

Next, transfer bias control as one of the image forming conditions will be described.

In the transfer bias control, similarly to the above described image forming condition, in order to resolve the density deviation in the image part front end caused by the development history, the transfer bias is set according to the development history to prevent the toner density in the image part front end from being higher than other parts, thereby resolving the density deviation.

Particularly, since the development history is influenced by the number of times that the developing roller faces the non-image part or the image area size passing through the transfer position in the main scanning direction, the transfer bias is adjusted by categorizing the development history into a case in which the image part reaches directly after the transfer position and a case in which the non-image part reaches directly after the transfer position.

Figure 10:
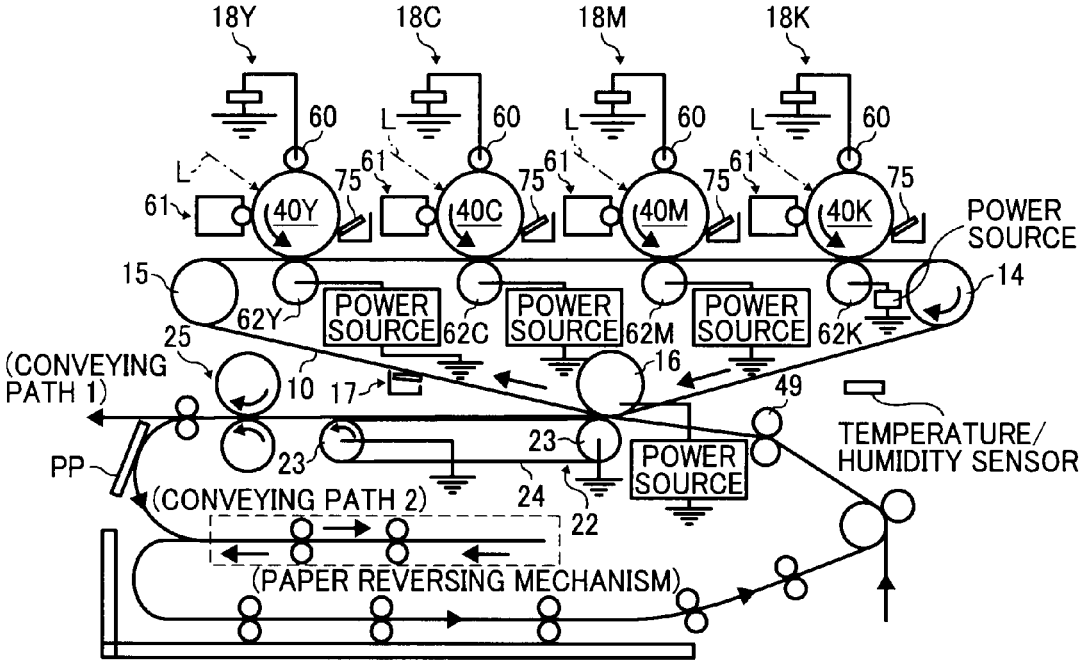
FIG. 10 is a schematic view illustrating another example of an image forming apparatus.

FIG. 10 illustrates an example of an image forming apparatus in which the transfer bias control is performed. In FIG. 10, members having the same functions as the members illustrated in FIG. 1 are denoted as the same reference numerals.

Image forming characteristics of respective members illustrated in FIG. 10 are as follows.

The photoconductive drum (for convenience, only a numeral is used) 40 includes an organic photoconductor, and the capacitance of the photoconductive layer is set to 9.5E-7 ($F/m^2$).

The developing device 61 uses a two-component developer that has a diameter of 25ϕ and is carried on a surface of the developing roller having a line speed of 450 mm/s.

The primary transfer roller 62 is made of a roller material (excluding a cored bar) having a volume resistivity of 1E9 Ωcm. The intermediate transfer belt 10 onto which the toner image created on each photoconductive drum is transferred is composed of a carbon-dispersed polyimide belt having a thickness of 60 μm, a volume resistivity of about 1E9 Ωcm (a measurement value at the time of an applied voltage 100 V by Hiresta-UP MCP HT450 manufactured by Mitsubishi Chemical Corporation), and tensile elasticity of 2.6 Gpa. A secondary transfer roller 16 used for collectively transferring the images that are transferred onto the intermediate transfer belt 10 in the superimposed manner is made of a roller material (excluding a cored bar) having a volume resistivity of 1E9 Ωcm, and a facing roller 23 is made of a roller material (excluding a cored bar) having a volume resistivity of 1E9 Ωcm.

In the fixing device 25 for fixing the images collectively transferred on the recording material through the secondary transfer, image fixing is performed at a fixing temperature of 165° C.

The image forming apparatus illustrated in FIG. 10 includes a reversing mechanism for reversing the recording material at the time of double-side image printing, a transport guide PP for switching the conveying path of the recording material, a conveying path 1 for discharging the recording material after fixing "as is", and a conveying path 2 for reversing the recording material to be recirculated toward the resist roller 49 when forming an image on both sides of the recording material.

In the image forming apparatus illustrated in FIG. 10, the line speed of the image forming process is set to about 280 mm/s.

In the image forming apparatus illustrated in FIG. 10, when the photoconductive drum 40 is uniformly charged to −650 V by the charging device 60, the electrostatic latent image is formed based on image information by a writing device 21. Electric potential of the electrostatic latent image part is about −100 V.

The electrostatic latent image is converted to a visible image as a toner image by the developing roller in which a negative charged toner having a charge amount of about −20 μC/g is used and a developing bias of −500 V is applied. The toner image has the toner of about 0.6 $mg/cm^2$ attached thereto.

The toner image is primary-transferred to the intermediate transfer belt 10 due to transfer electric field formed by the toner and the negative current in the primary transfer roller 62. The images superimposed by the primary transfer are collectively transferred onto the recording material through a secondary transfer roller 23 as described above, and the recording material is conveyed to the fixing device 25 and fixed.

The transfer bias control will be described below in connection with the above-described configuration.

First, in the present embodiment, set are the printing rate in the main scanning direction when passing through the transfer position and the transfer bias after determining whether or not an area already passing through the transfer position is the whole non-image area.

Figure 11:
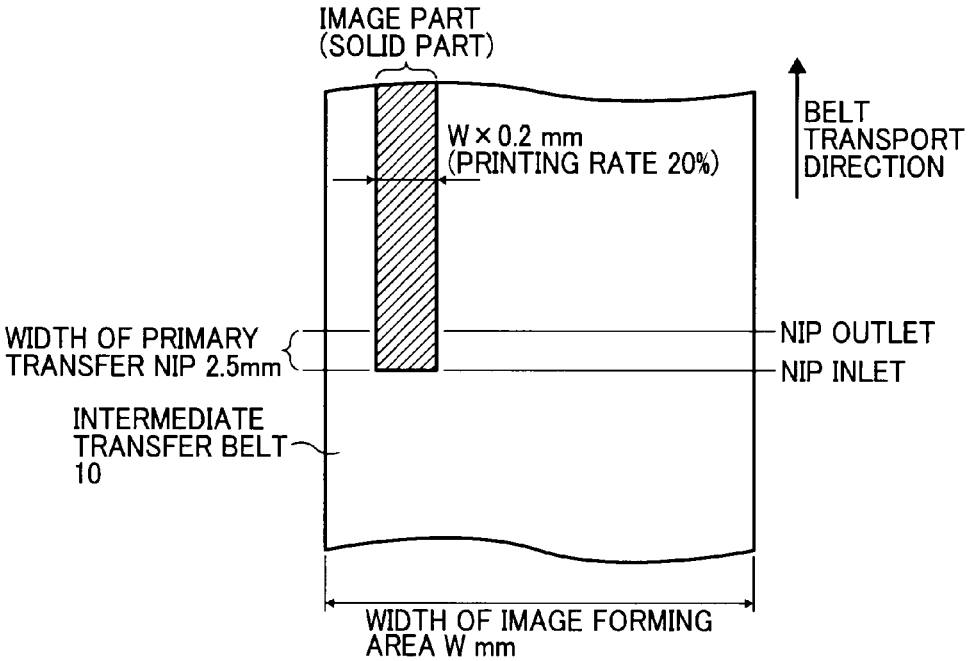
FIG. 11 is a view for explaining a definition of a printing rate.

The printing rate corresponds to a rate that the printing area in the main scanning direction corresponding to the direction perpendicular to the moving direction of the intermediate transfer belt 10 occupies in an area in which an image can be formed as illustrated in FIG. 11. The printing rate is computed using recording information such as a recording signal from a computer or a scanner that outputs image information, and the length of the non-image area is similarly computed from image information.

The transfer bias current is set based on the above-described printing rate as in any one of Formulas 4 to 6 below.

$$I1=-13.16\times\eta 1+41.66 \quad (4)$$

(Here, a target is a case in which the image part is present in an area at the downstream side in the belt moving direction at $\eta 1>0$ and a toner charge amount of −20 μC/g)

$$I1=-10.53\times\eta 1+35.53 \quad (5)$$

(Here, a target is a case in which the whole non-image part is present in an area at the downstream side in the belt moving direction at $\eta 1>0$ and a toner charge amount of −20 μC/g)

$$I1=5 \quad (6)$$

(Here, a target is a case in which the image part is present in an area at the downstream side in the moving direction at $\eta 1>0$)

In this case, I1 is the primary transfer current at the upstream side in the moving direction of the intermediate transfer belt, and $\eta 1$ means the printing rate at the most upstream side.

Figure 12:
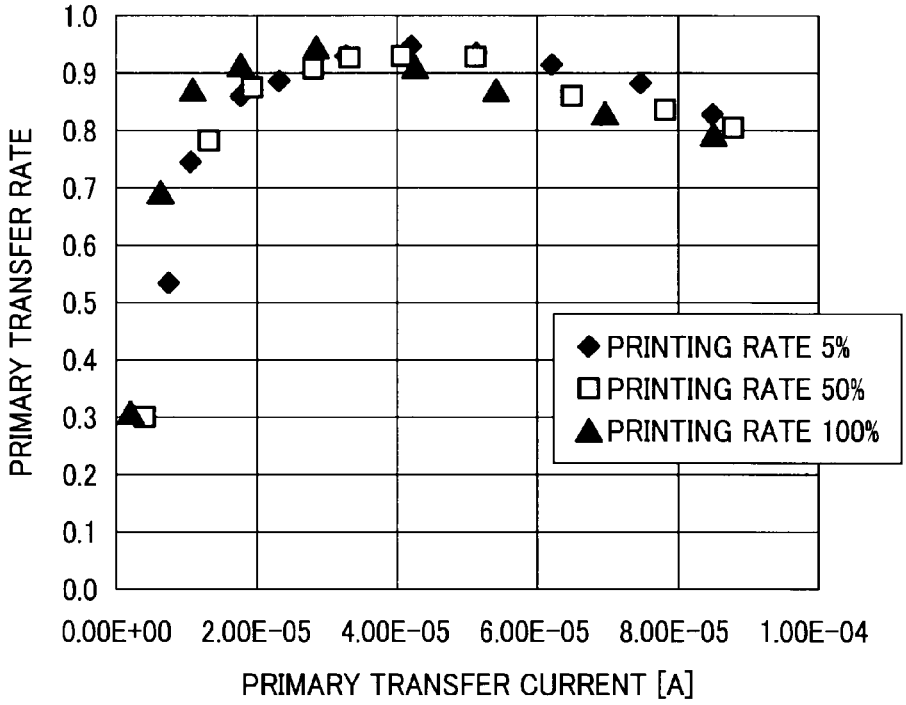
FIG. 12 is a view for explaining a relationship among a printing rate, transfer efficiency, and a transfer current.

The reason for controlling the transfer current according to the printing rate is because a value of the primary transfer rate minus the primary transfer current depends on the printing rate as illustrated in an experimental result illustrated in FIG. 12.

That is, in the result of FIG. 12, the value of the primary transfer current in which the primary transfer rate becomes maximum is smaller as the printing rate is higher and larger as the printing rate is lower. Based on the result, control of reducing the primary transfer current as the printing rate increases is performed.

Formulas 4 to 6 are derived based on the experimental result illustrated in FIG. 12. For example, when an increment in image density of the solid image (about 1.50 at the time of continuous printing of the solid image) directly behind the non-image part is about 0.05 (an increment in the toner attachment amount on the photoconductor after developing about 0.02 mg/cm$^2$), the density unevenness can be suppressed by reducing the transfer efficiency by about 2%.

Meanwhile, based on the result illustrated in FIG. 12, even when the occurrence of density unevenness with respect to the printing rate is suppressed by controlling the transfer current, similarly to the above-described embodiment, the density deviation occurs in the image part front end directly behind the non-image part according to the length Lg of the non-image part directly ahead of the image part in the image carrier moving direction.

That is, at one primary transfer position of the transfer positions, similarly to the above-described embodiment, parts having different toner density due to the development history occur in the image part front end directly behind the non-image part depending on the number of times that the developing roller faces the non-image part or the printing rate.

Figure 13A:
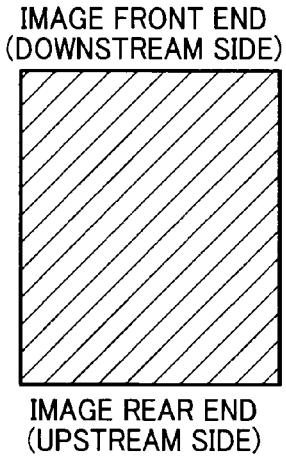
FIGS. 13A to 13C are views illustrating a result of comparing a case of performing control on a transfer bias condition with a case of not performing the control.
Figure 13B:
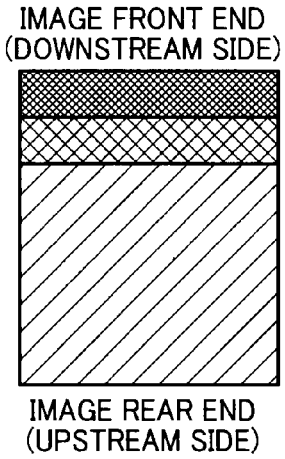

FIG. 13B illustrates a state of the image part front end when a constant transfer bias (current or voltage) is set to an original image illustrated in FIG. 13A. Even when the transfer bias control is performed according to the printing rate as described above, a part having high toner density (a large toner attachment amount) appears in the image part front end directly behind the non-image part.

Figure 13C:
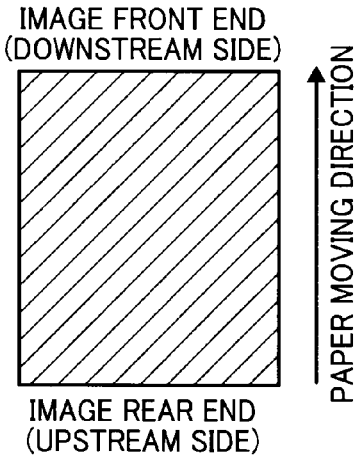
Figure 14:
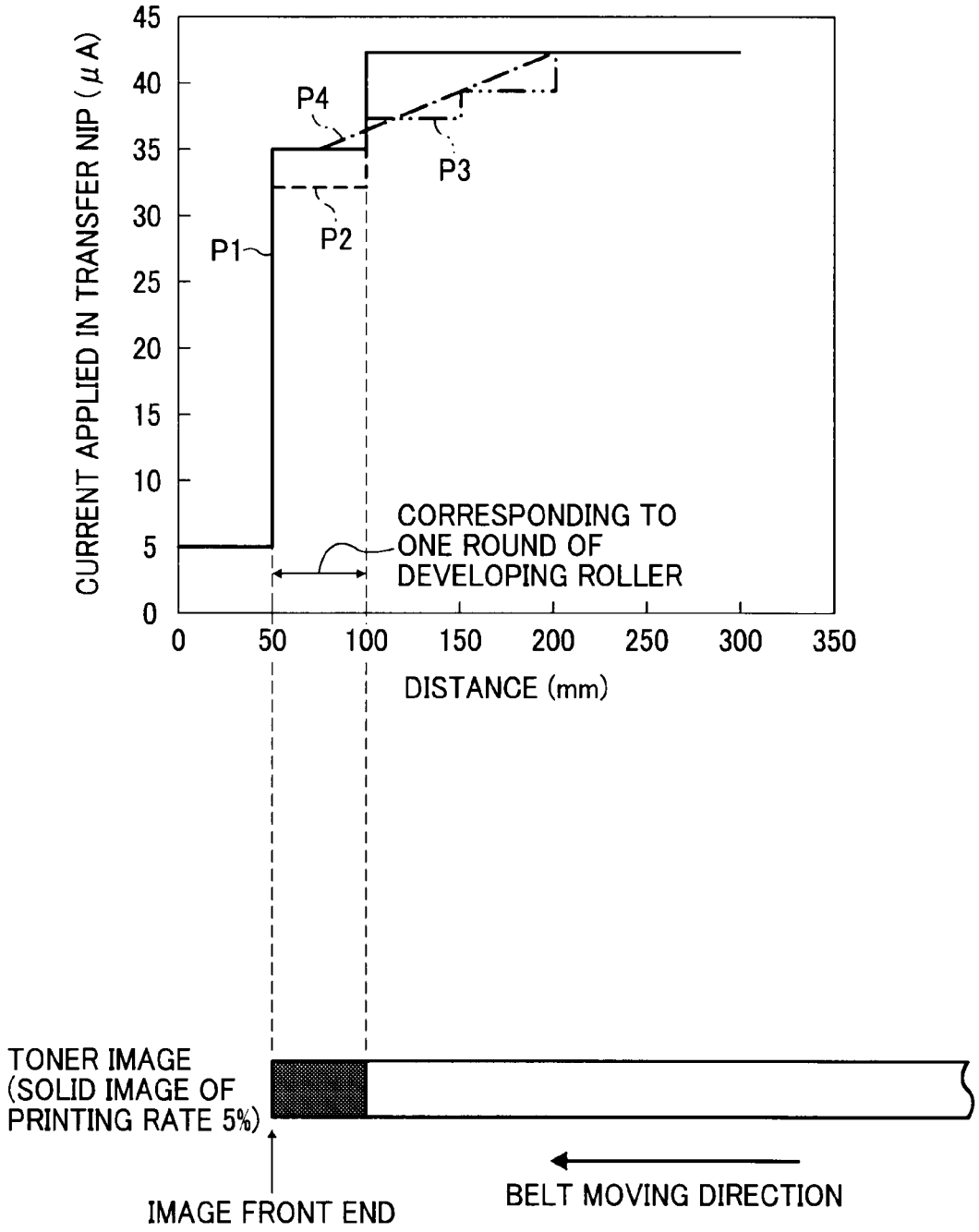
FIG. 14 is a diagrammatic view for explaining a setting condition of a transfer bias condition according to the present embodiment and illustrating a transfer bias control part on a transfer body.

In the present embodiment, in the transfer bias control, when the length of the non-image part of the image part front end has the relationship of Equation 1, the transfer bias that targets the predetermined length, in the image carrier moving direction, from the image front end directly behind the non-image part is set to a value lower than the transfer bias that targets typical control as designated as P1 in FIG. 14. As a result, the transfer efficiency is lowered, and a phenomenon illustrated in FIG. 13B is prevented from occurring. Therefore, as illustrated in FIG. 13C, the density deviation is invisible.

Further, as the area of the non-image part is larger, that is, the length Lg of the non-image part directly ahead of the image part in the image carrier moving direction is larger, the density of the image directly behind the non-image part is higher. Therefore, the width for reducing the transfer current is preferably changed according to the length of the non-image part as illustrated as P2 in FIG. 14.

Further, as illustrated in FIG. 14, the history of the image density distinguishably appears in the corresponding image area while the developing roller rotates one round directly after the non-image part and does not appear together with printing of the image. If the image directly after the non-image part is not the solid image but the half tone image, while the developing roller rotates two rounds or three rounds, it is recognized as the density difference. Therefore, as designated as P3 and P4 in FIG. 14, the transfer current is controlled according to the distance from the whole non-image part to further reduce density unevenness. Here, in any case, control of reducing the transfer current is performed within a range corresponding to one round of the developing roller.

However, in the present embodiment, the primary transfer current value is changed according to the printing rate, but as described above, the transfer current value in which the transfer efficiency is maximum changes according to a non-image part potential of the photoconductor, an image part potential, and a charge amount of the toner.

Further, since the a transferred toner amount or a discharge current amount per unit time changes according to a moving speed (hereinafter, referred to as "process speed") of the intermediate transfer belt or the recording material, coefficients of Equation 3 are corrected in an image forming apparatus in which theses factors greatly change. Particularly, the non-image part potential of the photoconductor or the toner charge amount generally change in a temperature/humidity environment, Formulas 4 to 6 may be corrected based on information of the temperature/humidity sensor 16 as follows.

For example, when only the toner charge amount changes in the condition in which an initial charge potential (−650 V constant) of the photoconductor or a toner amount (0.6 mg/cm$^2$) developed on the photoconductor is fixed, a function for computing the primary transfer current in view of the toner charge amount may be expressed, for convenience, as Modified Equation 1 consolidated by correcting Formulas 4 to 6 as follows.

(Modified Equation 1)

$$I1=-(13.16+(Q1+20)/20\times 8.01)*\eta 1+41.66$$

(when an image is present in a downstream area at $\eta 1>0$ of the toner charge amount of −20 μC/g)

$$I1=-(10.53+(Q1+20)/20\times 8.01)\eta 1+35.53$$

((when a whole surface non-image part area is present in a downstream at $\eta 1>0$ of the toner charge amount of −20 μC/g and Equation 2 is satisfied)

Here, Q1 is the toner charge amount [μC/g]. This function is an experimental formula set so that the primary transfer current amount at the time of the solid image of the printing rate 100% increases as the toner charge amount increases.

Meanwhile, when the process speed changes according to the thickness of the paper on which printing is performed or the resolution, a function of computing the primary transfer current in view of the process speed may be expressed, for convenience, as Modified Equation 2 consolidated by correcting Formulas 4 to 6 as follows.

(Modified Equation 2)

$$I1=(-13.16\times\eta 1+41.66)*vp/280$$

(when an image is present in a downstream area at $\eta 1>0$ and a toner charge amount of −20 μC/g)

$$I1=(-10.53\times\eta 1+35.53))*vp/280$$

(when a whole surface non-image area is present at a downstream at $\eta 1>0$ and a toner charge amount of −20 μC/g and Equation 4 is satisfied)

Here, vp is the process speed [mm/s]. In this function, control is performed such that as the process speed increases, the primary transfer current amount increases.

Further, Formulas 4 to 6 and formulas (Modified Formulas 1 and 2) in which Formulas 4 to 6 are corrected are functions applied when an increment in an toner attachment amount on the photoconductor after development directly after the non-image part is about 0.02 mg/cm$^2$. The degree of the development history is affected by a nature of a toner or a carrier, a difference between a charge potential of the photoconductor and an applying voltage to the developing roller as well as the configuration of the developing device. Therefore, a control function is decided for each station after understanding a way in which the development history appears in advance.

Alternatively, control may be performed for each station based on a predetermined table according to whether or not the non-image part is present in the downstream, the charge amount or the printing rate of the toner, or the charge potential of the photoconductor without using a function.

The printing rate used as a reference in performing control is not limited to an outlet of the primary transfer nip, and an average value of the printing rates present at the center of the primary transfer nip or in the primary transfer nip may be used. Further, control may be performed in a border range. For example, an average printing rate per 100 pixels in the sub scanning direction or per one sheet of image may be used. In this case, current control is not performed for each pixel in the sub scanning direction, but control may be performed for every width/process line speed second or for every 1000 pixels or every one sheet of image. In this case, the constant effect of reducing the waste toner amount is obtained.

However, in the present embodiment, image density unevenness caused by the development history is reduced in the two-component developing device, but the degree of the development history is more remarkable in the single-component developing device, and thus the invention provides more effects in the image forming apparatus of the single-component developing method.

Particularly, when a material of the developing roller of the single-component developing device is pure or metal such as an alumite-processed aluminum, steel use stainless (SUS), or brass, the development history becomes remarkable due to the scrape of the surface, and thus the invention is particularly effective. Further, since the development history needs to be suppressed by strongly pressing the toner feeding roller made of sponge or excessively increasing feeding o the toner to the developing roller, it is possible to reduce heat generation caused by friction when the line speed of the developing roller is fast or toner fixing to the developing roller. The solution of the invention of preventing the development history caused by the transfer current is not limited to control of the primary transfer current but may be performed by the second transfer current.

A method of controlling a voltage applied to the developing sleeve may be used in order to suppress density unevenness. It is advantages because the stance from the exposure position of the photoconductor to the transfer nip is larger than the distance between the exposure position and the developing nip, and a time for computing a voltage controlled based on image information is secured.

Figure 15:
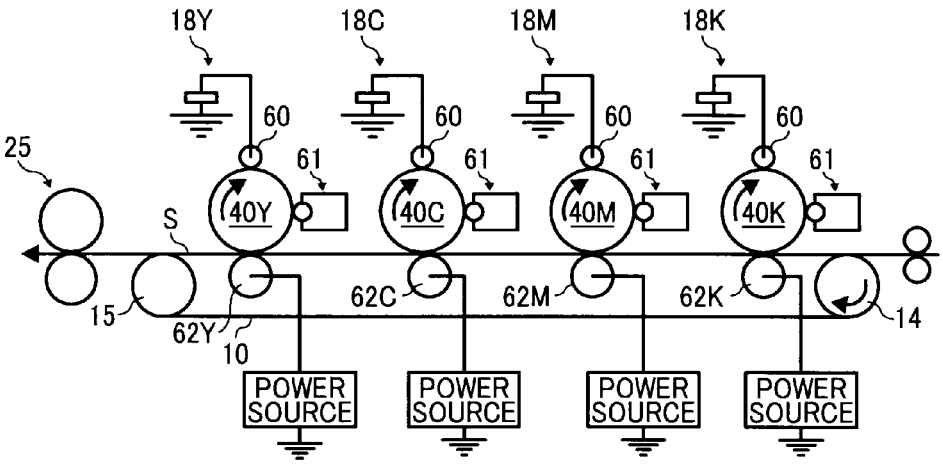
FIG. 15 is a view illustrating an example in which the image forming apparatus illustrated in FIG. 10 is partially modified.

The image forming apparatus illustrated in FIG. 10 targets a configuration of sequentially transferring each color onto the intermediate transfer belt 10, but may be applied to a configuration of moving a transfer sheet S between respective image units while attracking the transfer sheet S directly onto the belt and sequentially transferring an image onto the transfer sheet as illustrated in FIG. 15.

Figure 6:
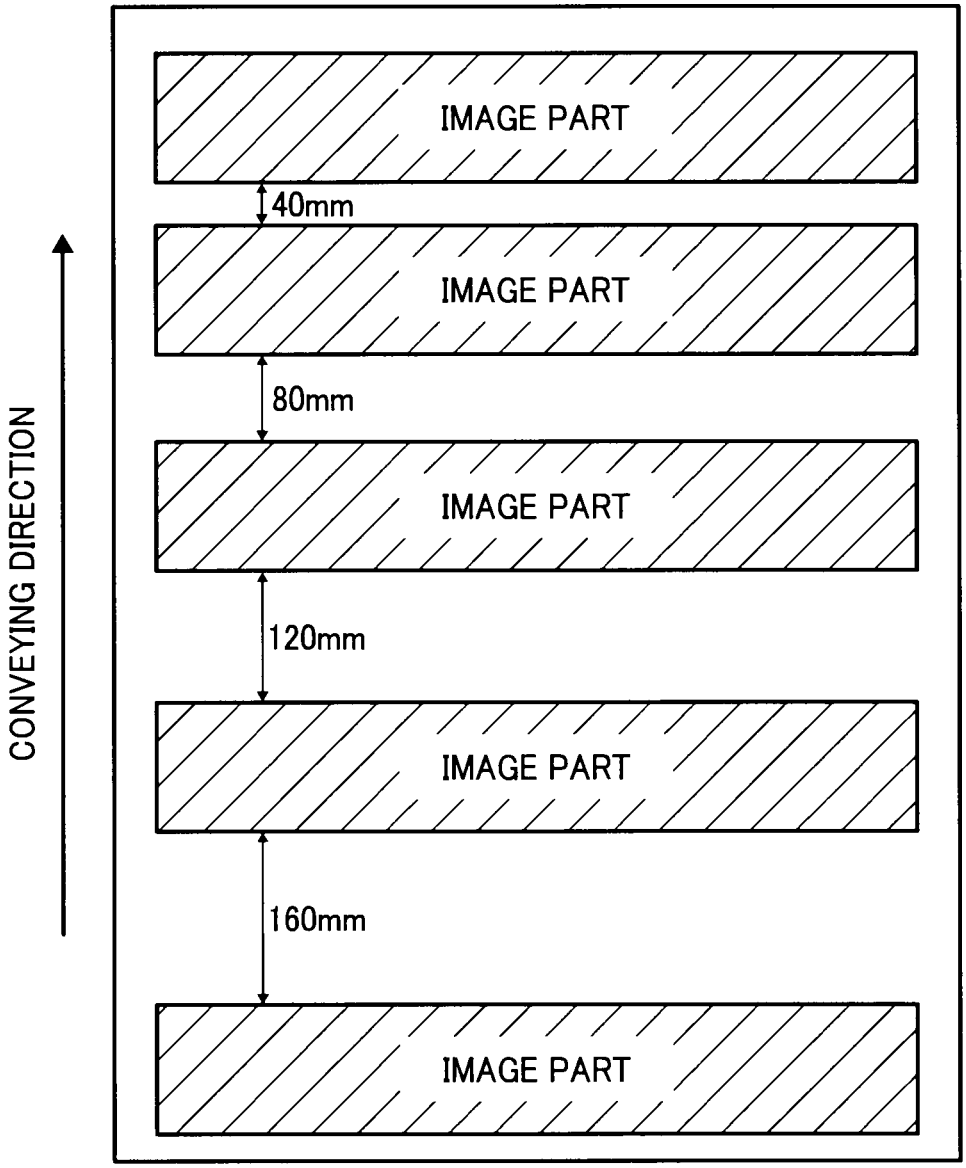
FIG. 6 is a view illustrating an example of an image state in which density deviation is resolved as a feature of the invention.
Figure 16:
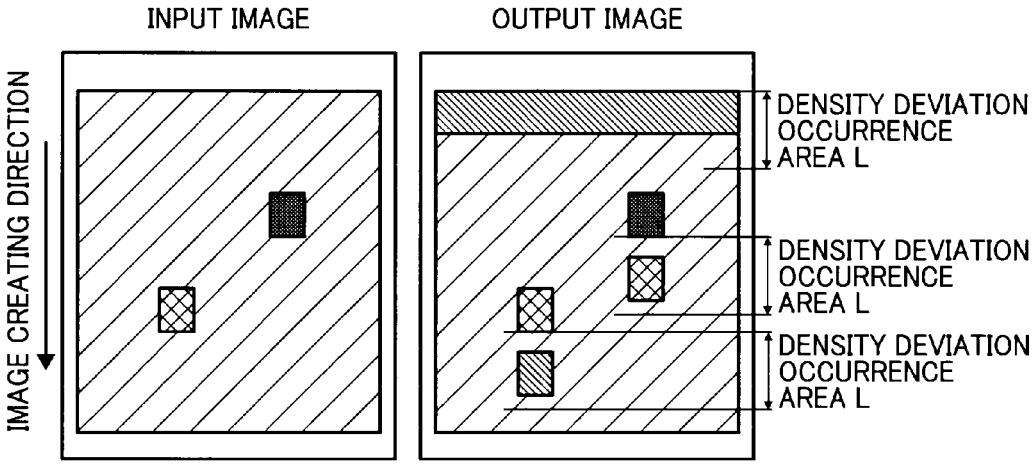
FIG. 16 is a view illustrating another example of an image state in which density deviation is resolved as a feature of the invention.

In the above-described embodiment, all of the predetermined length from the image front end in the image carrier moving direction is defined as the non-image part area in the photoconductor axial direction (the direction perpendicular to the paper transport direction) as illustrated in FIG. 6, but points in which the density deviation occurs in the photoconductor axial direction may be targeted as illustrated in FIG. 16.

FIG. 16 illustrates the density deviation in an area in which an image pattern in an output image changes using a plurality of input images.

In FIG. 16, when an image pattern changes, the density deviation occurs in this area, but the degree of the density deviation depends on a combination of before and after image patterns in which changing points are used as a boundary.

When a difference of the image density or the area rate between before and after image patterns is large, the density deviation relatively increases, whereas when the difference of the image density or the area rate between before and after image patterns is small, the density deviation relatively decreases.

Further, the density deviation is affected by an order in which an image pattern changes. For example, the degree of the density deviation or a deviation direction (that becomes thicker or thinner) is different when a patter having high image density changes to a pattern having low image density and when a patter having low image density changes to a pattern having high image density.

Figure 17:
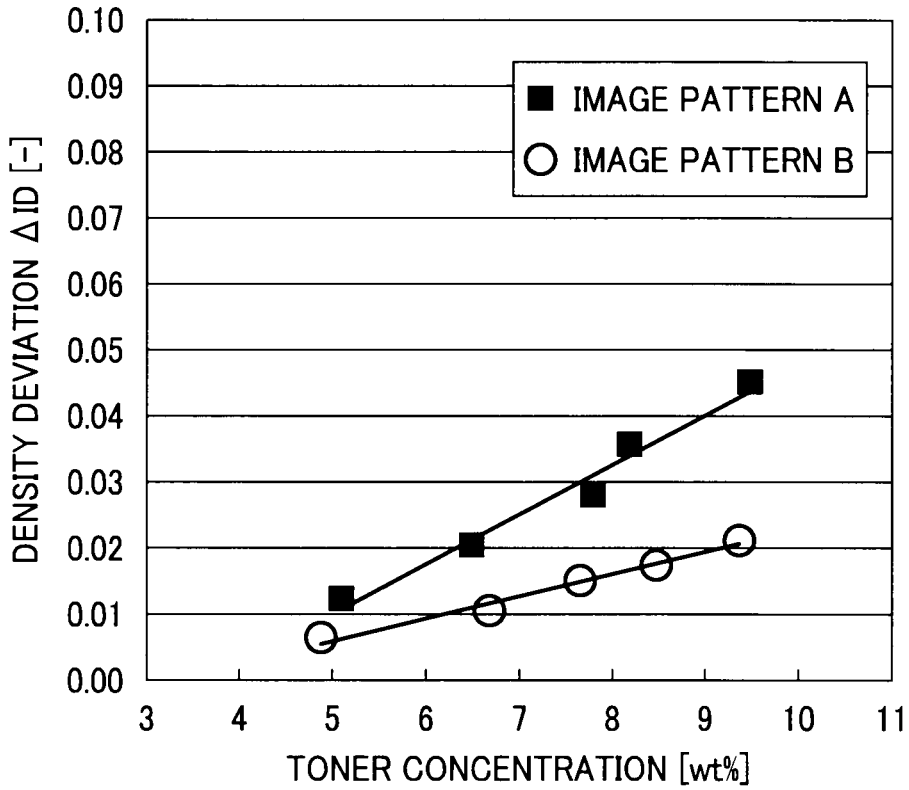
FIG. 17 is a diagrammatic view for explaining a relationship between density deviation and toner density.

The inventor(s) conducted an experiment on a relationship between the density deviation and the toner density and obtained a result that when the toner density changes, the density deviation also changes as illustrated in FIG. 17. The result illustrated in FIG. 17 is an experiment result in which a pattern A and a pattern B are used as before and after images in which an image pattern changes. A change width is different depending on each pattern, but it can be understood that the density deviation changes depending on the toner change.

As described above, when there is a tendency that the density deviation increases according to a change in the toner density, the control amount of the image forming condition increases, and when there is a tendency that the density deviation decreases according to a change in the toner density, the control amount of the image forming condition decreases.

In the present embodiment, the length Lg of the non-image part directly before the image part in the image carrier moving direction is computed from the input image patterns in the different toner conditions using a plurality of input image patterns. Similarly to the above-described embodiment, when the length Lg of the non-image part directly before the image part in the image carrier moving direction satisfies the relationship of Equation 1, control of adjusting the three items of the exposure power and the exposure time for the photoconductor and the developing bias for the developing sleeve (that targets the applying voltage) among the above-described image forming conditions is performed, and the density deviation occurred was quantitatively evaluated as a density difference ΔID between a point in which deviation occurred and a point therearound, so that results illustrated in FIGS. 18 and 19 were obtained.

FIGS. 18 and 19 illustrates results of quantitatively evaluating the predetermined length from the image front end in the image carrier moving direction and the density difference therearound by controlling the exposure energy, the exposure time, and the developing bias when a plurality of image patterns is different in toner density (TC). In this case, the predetermined length from the image front end in the image carrier moving direction was computed based on the following condition.

Photoconductor charge potential (Vd): −700 (V)

Photoconductor rotation circumferential velocity (Vp): 205 (mm/s)

Developing sleeve rotation circumferential velocity (Vp): 369 (mm/s)

Developing sleeve diameter (Ds): 18 (mm)

In this condition, as the predetermined length L from the image front end in the image carrier moving direction, $L=3.14\times18/(369/205)\cong31$ (mm) is computed by Equation 2.

In the results illustrated in FIGS. 18 and 19, an area in which the density deviation occurs at a position in which an image pattern changes from the whole-surface non-image part to the whole surface image part throughout the main scanning direction of the photoconductor, the density deviation is reduced by adjusting the developing bias used in the developing device with respect to the case that targets the typical control. That is, in FIGS. 18 and 19, the density difference designated as ΔID can be reduced.

However, when the image front end position is not the same in the main scanning direction as illustrated in FIGS. 7A to 7E and the image front end corresponding to a point in which the density deviation occurs is non-uniformly present, it is preferable to resolve the density deviation by targeting only that point. For this reason, in the present embodiment, adjusting the exposure amount is performed in the main scanning direction. As a result, when the density deviation can be resolved by the developing bias, only the developing bias is preferably used, and the exposure amount adjustment on the photoconductor is not performed more than necessary, thereby resolving the density deviation while suppressing optical fatigue of the photoconductor.

Figure 20:
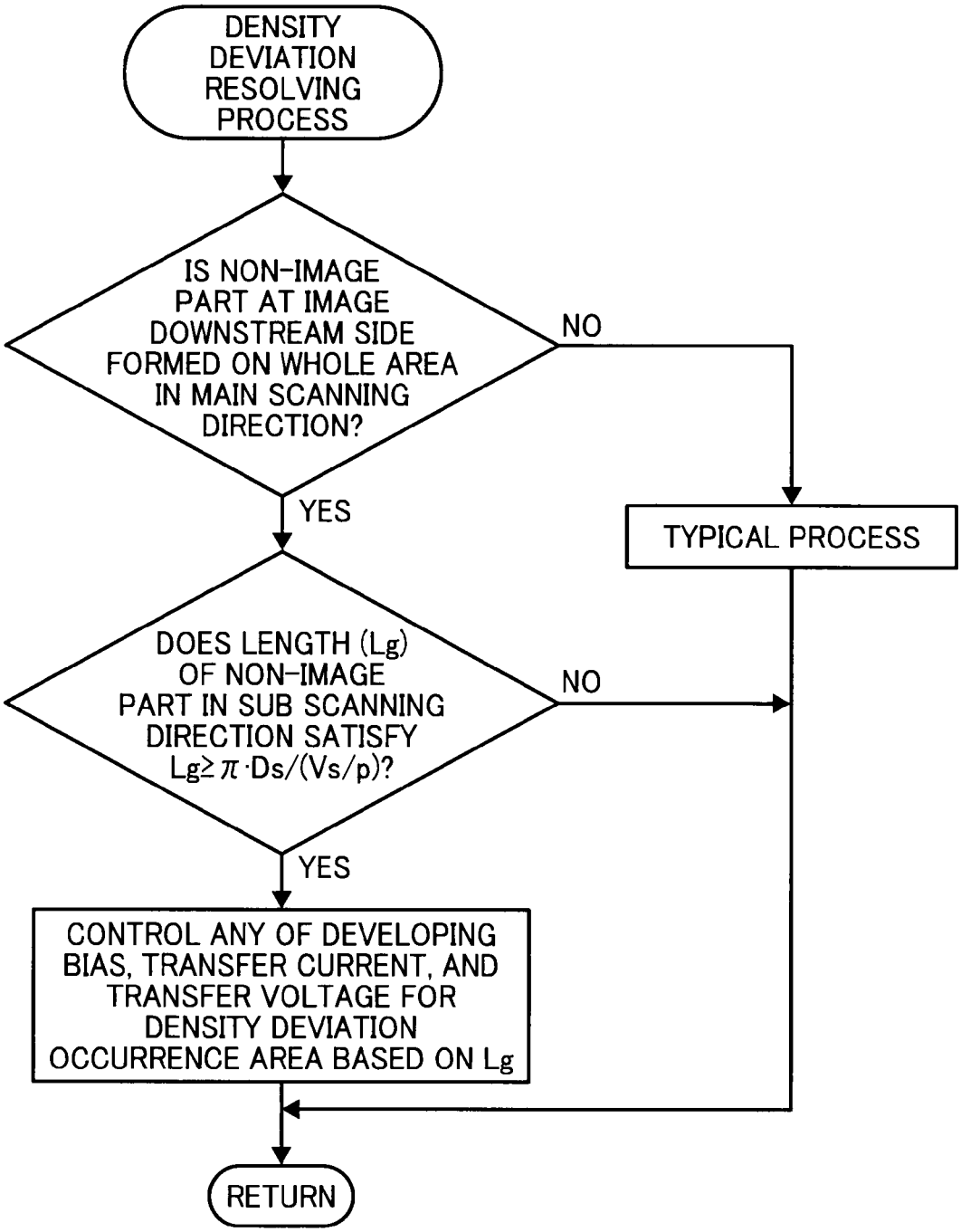
FIG. 20 is a flowchart for explaining a procedure when control is performed on any of a developing bias, a transfer current, and a transfer voltage as a control procedure according to the present embodiment.
Figure 21:
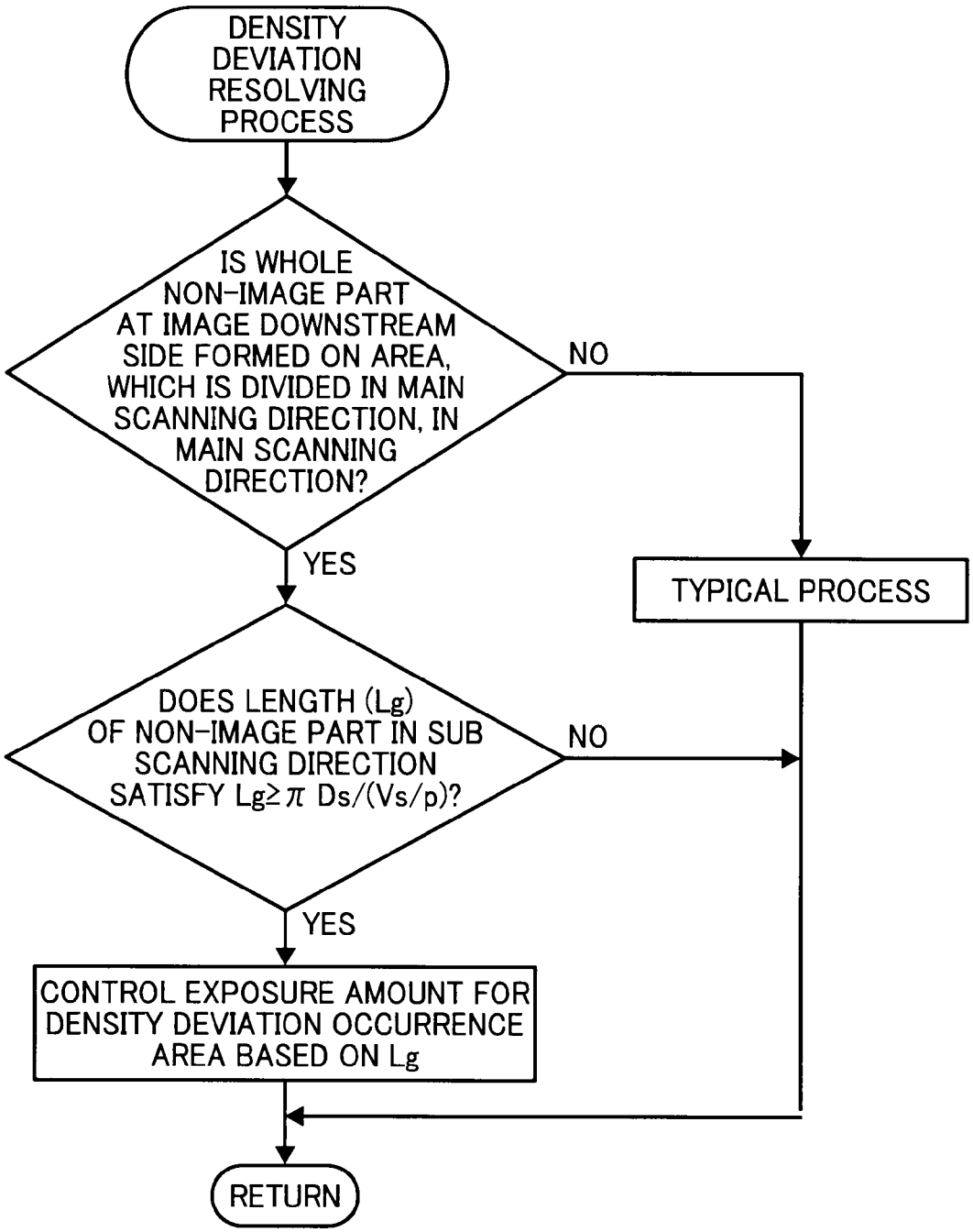
FIG. 21 is a flowchart for explaining a procedure when control is performed on any of a developing bias, a transfer current, and a transfer voltage as a control procedure according to the present embodiment.

FIGS. 20 and 21 are flowcharts for explaining procedures of suppressing attachment of the toner in the predetermined length from the image front end in the image carrier moving direction according to the present embodiment.

FIG. 20 illustrates a case in which for the image pattern illustrated in FIG. 6, any of the developing bias, the transfer current, and the transfer voltage among the image forming conditions is a control target, and FIG. 21 illustrates a case in which for the image pattern illustrated in FIGS. 7A to 7E, the exposure amount among the image forming conditions is a control target.

Further, the invention is not limited to selecting any of the image forming, as conditions and controlling it as described in the embodiment and may be applied to performing control by combining a plurality of conditions. For example, when only the exposure amount is used, deterioration of the photoconductive layer may be accelerated depending on setting of the exposure power. In this case, the developing bias may be combined with the exposure amount to cope with a case in which the toner attachment amount can not be reduced only by the exposure amount.

Further, in the invention, control of suppressing the toner attachment amount means control that makes the toner hardly attached, and the actual attachment amount is not reduced. That is, since more toners are attached when typical control is performed, it means that the density deviation is suppressed by making the toner hardly attached.

According to an aspect of the invention, if Lg, which is the length Lg of the non-image part directly before the image part in the image carrier moving direction and which is generated in the image front end directly after the image pattern for the peripheral length pitch of the developer carrier along the image carrier moving direction changes from the non-image part to the image part, has the relation of Equation (1), which is $$Lg\geq\pi\cdot Ds/(Vs/Vp),$$

control of suppressing the toner attachment amount is performed on the predetermined length from the image front end in the image carrier moving direction, whereby it is possible to suppress the occurrence of the density deviation in the image front end transferred onto the recording material.

Further, according to another aspect of the invention, when for the predetermined area divided in the axial direction of the image carrier, the length Lg of the non-image part directly before the image part in the image carrier moving direction satisfies the relation of Equation 1, the exposure amount, the exposure power, the exposure time, or any combination thereof, or the transfer bias or the developing bias is controlled to be decreased for the predetermined length from the image front end in the image carrier moving direction, for the predetermined area divided in the axial direction of the image carrier. Thus, even of the image pattern is irregularly present in the axial direction of the image carrier, it is possible to suppress the occurrence of the density deviation at the front end of the image part per the divided predetermined area.

Further, according to still another aspect of the invention, based on the number of printing pixels, the toner attachment amount in the predetermined length from the image front end in the image carrier moving direction is controlled from becoming different from the toner attachment amount for the image portion other than a region of the predetermined length from the image front end of the image part in the image carrier moving direction due to the development history, by performing the control of suppressing or increasing the toner attachment amount with respect to the predetermined length from the image front end in the image carrier moving direction. As a result, it is possible to suppress the density deviation in the predetermined length from the image front end in the image carrier moving direction. In other words, it is possible to suppress the occurrence of the density deviation in the predetermined length, in the image carrier moving direction, from the front end of the image transferred onto the recording material.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrier;

an exposing unit configured to perform write scanning on the image carrier according to image information;

a developing unit that includes a developer carrier configured to carry a developer including a toner and that is configured to perform a visible image process on an electrostatic latent image formed on the image carrier; and a control unit configured to perform control of suppressing a toner attachment amount on a recording material in a predetermined length from a front end of an image in an image carrier moving direction if length Lg of a non-image part directly before an image part in an image carrier moving direction has the relation of $$Lg \geq \pi \cdot Ds/(Vs/Vp),$$

where Vp is a circumferential velocity of the image carrier, Vs is a circumferential velocity of the developer carrier, and Ds is a diameter of the developer carrier.

2. The image forming apparatus according to claim 1, wherein the control unit performs the control of suppressing the toner attachment amount such that the longer the length Lg from the non-image part directly before the image part in the image carrier moving direction is, the smaller the toner attachment amount in the predetermined length from the front end of the image in the image carrier moving direction is.

3. The image forming apparatus according to claim 1, wherein a static electricity amount according to an exposure condition with respect to the image carrier in the predetermined length from the front end of the image in the image carrier moving direction or a toner attachment amount according to a developing bias with respect to the image carrier in the predetermined length from the image front end in the image carrier moving direction is set according to the number of printing pixels, and if printing of a predetermined number of pixels or more is performed, the static electricity amount or toner attachment amount with respect to the image carrier is suppressed, as compared with a case in which printing of less pixels than the predetermined number of pixels is performed.

4. The image forming apparatus according to claim 3, wherein a tendency of a deviation to occur in the predetermined length from the image front end in the image carrier moving direction is determined using a difference in image density or a difference in area rate based on the number of printing pixels, and the toner attachment amount in the predetermined length from the front end of the image in the image carrier moving direction is determined based on a remaining state of the toner obtained based on the image density or the area rate.

5. The image forming apparatus according to claim 1, wherein if the relation is satisfied, the write scanning is performed by controlling an exposure condition by the exposing unit for the predetermined length from the image front end in the image carrier moving direction so that a change in electric potential of the image carrier becomes small.

6. The image forming apparatus according to claim 5, wherein an exposure amount, an exposure power, an exposure time, or any combination thereof is used as the exposure condition.

7. The image forming apparatus according to claim 1, wherein if the relation is satisfied, the visible image process is performed by controlling an absolute value of a developing bias applied to the developing unit in the predetermined length from the image front end in the image carrier moving direction to be smaller than a reference value.

8. The image forming apparatus according to claim 1, wherein if the relation is satisfied, an image transfer is performed by controlling a voltage or current used as a transfer bias on the transfer unit for the predetermined length from the image front end in the image carrier moving direction to be small.

9. The image forming apparatus according to claim 1, wherein if the relation is satisfied in any of predetermined areas divided in an axial direction of the image carrier, the toner attachment amount on the recording material is suppressed by reducing an exposure amount in the predetermined length from the front end of the image in the image carrier moving direction for each of the predetermined areas satisfying the relation.

10. The image forming apparatus according to claim 9, wherein if control of making an exposure amount, an exposure power, an exposure time, or any combination thereof, or a transfer bias or a developing bias, in the predetermined length from the front end of the image in the image carrier moving direction smaller than that for when an image portion other than a region of the predetermined length from the front end of the image in the image carrier moving direction in the image part is targeted is performed, each length of the predetermined areas in a main scanning direction perpendicular to the image carrier moving direction is set to be less than ⅔ mm.

11. The image forming apparatus according to claim 1, wherein the control unit computes the number of times that the developing unit passes the non-image part by calculating $$Lg/(\pi Ds(Vs/Vp),$$

and performs the control of suppressing the toner attachment amount such that the larger the number of passed times is, the smaller the toner attachment amount in the predetermined length from the front end of the image in the image carrier moving direction is.

12. The image forming apparatus according to claim 1, wherein the predetermined length is set to $$n\pi \cdot Ds/(Vs/Vp),$$

where n is an integer equal to one or greater.

* * * * *